US012662746B2

(12) United States Patent
Tomantschger

(10) Patent No.: US 12,662,746 B2
(45) **Date of Patent: *Jun. 23, 2026**

(54) ARTICLES COMPRISING THERMALLY STABLE, GRAIN-REFINED ALLOYS

(71) Applicant: Integran Technologies Inc., Mississauga (CA)

(72) Inventor: Klaus Tomantschger, Mississauga (CA)

(73) Assignee: Integran Technologies Inc., Mississauga (CA)

( * ) Notice: Subject to any disclaimer, the term of this patent is extended or adjusted under 35 U.S.C. 154(b) by 895 days.

This patent is subject to a terminal disclaimer.

(21) Appl. No.: 17/868,382

(22) Filed: Jul. 19, 2022

(65) Prior Publication Data

US 2024/0026556 A1 Jan. 25, 2024

(51) Int. Cl.
*C25D 1/00* (2006.01)

(52) U.S. Cl.
CPC ..... *C25D 1/00* (2013.01)

(58) Field of Classification Search
None
See application file for complete search history.

(56) References Cited

U.S. PATENT DOCUMENTS

| | | | |
|---|---|---|---|
| 3,880,725 | A | 4/1975 | Van Raalte |
| 5,314,608 | A | 5/1994 | Caballero |
| 5,538,615 | A | 7/1996 | Palumbo |
| 6,027,631 | A | 2/2000 | Broadbent |
| 6,406,611 | B1 | 6/2002 | Engelhaupt |
| 6,547,944 | B2 | 4/2003 | Schreiber |
| 7,425,255 | B2 | 9/2008 | Detor |
| 7,553,553 | B2 | 6/2009 | Palumbo |
| 8,025,979 | B2 | 9/2011 | Palumbo |
| 8,129,034 | B2 | 3/2012 | Palumbo |
| 8,663,819 | B2 | 3/2014 | Gonzalez |
| 8,906,515 | B2 | 12/2014 | Tomantschger |
| 9,005,420 | B2 | 4/2015 | Tomantschger |
| 9,970,120 | B2 | 5/2018 | Tomantschger |
| 10,513,791 | B2 | 12/2019 | Lomasney |
| 2003/0234181 | A1 | 12/2003 | Palumbo |
| 2005/0205425 | A1 | 9/2005 | Palumbo |
| 2010/0304179 | A1 | 12/2010 | Facchini |
| 2018/0327920 | A1 | 11/2018 | Tajiri |
| 2019/0127869 | A1 | 5/2019 | Tajiri |

(Continued)

OTHER PUBLICATIONS

Office Action of U.S. Appl. No. 17/868,409 dated Apr. 4, 2025, 20 pages.

(Continued)

*Primary Examiner* — Elizabeth Collister
(74) *Attorney, Agent, or Firm* — Rankin, Hill & Clark LLP

(57) ABSTRACT

Articles including electrodeposited layers of fine-grained alloys of Ni, Cu, Co, Fe and Zn with minor additions of B, O, P and S that provide high strength, ductility and thermal stability, are disclosed. The disclosure further relates to a process for fabricating the articles. Non-metallic additions of ≤2% are required to significantly increase the maximum temperature at which softening and grain-growth occurs. The grain-refined metallic layers or coatings are particularly suited for use in strong and lightweight parts required in aerospace, automotive and industrial applications subject to at least, at times, higher than ambient operating temperatures.

29 Claims, 1 Drawing Sheet

(56) References Cited

U.S. PATENT DOCUMENTS

| | | | |
|---|---|---|---|
| 2020/0131663 | A1 | 4/2020 | Jonnalagadda et al. |
| 2020/0190650 | A1 | 6/2020 | Tajiri |
| 2020/0291508 | A1 | 9/2020 | Tajiri |

OTHER PUBLICATIONS

Bowen Yue, Guangming Zhu, Yanwei Wang, Jianbo Song, Zheng Chang, Nana Guo, Mianguang Xu, Uncertainty analysis of factors affecting coating thickness distribution during nickel electrodeposition, Journal of Electroanalytical Chemistry, vol. 891, pp. 1-12 (Year 2021).

International Search Report and Written Opinion of PCT/CA2023/050952 dated Oct. 4, 2023, 9 pages.

International Search Report and Written Opinion of PCT/CA2023/050947 dated Oct. 4, 2023, 9 pages.

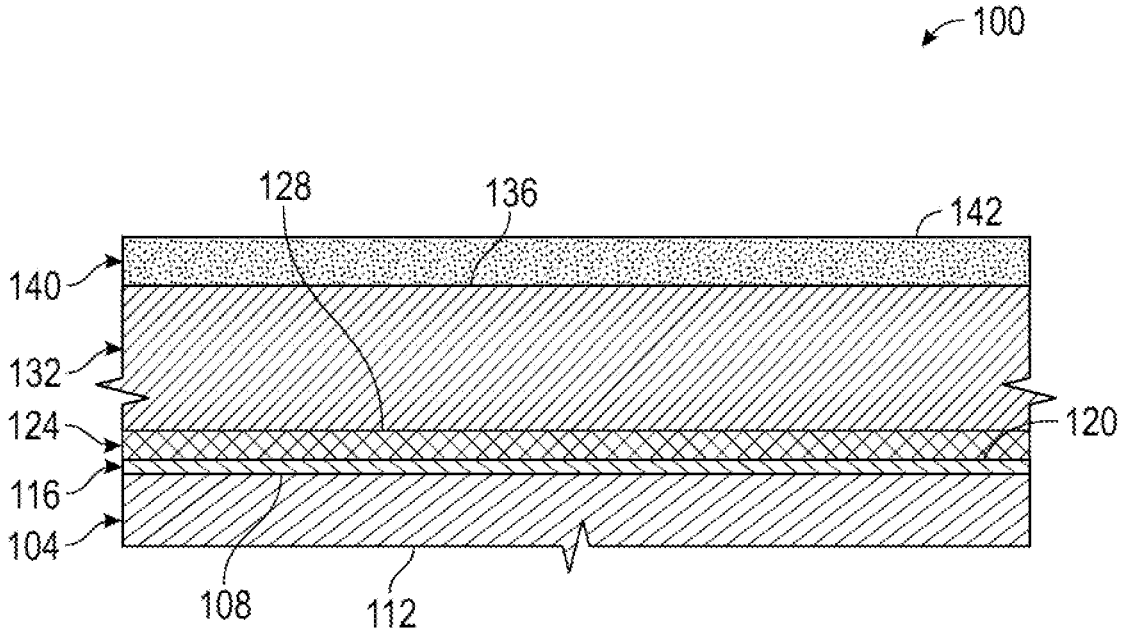
100
128
136
142
140
132
124
120
116
104
108
112

ARTICLES COMPRISING THERMALLY STABLE, GRAIN-REFINED ALLOYS

FIELD OF THE INVENTION

The invention relates generally to an article of manufacture comprising fine-grained alloys of Ni, Cu, Co, Fe and Zn with minor additions of B, O, P and S that provide high strength, ductility and enhanced thermal stability. The invention further relates to a process for fabricating the article.

BACKGROUND OF THE INVENTION

Electrodeposited metallic coatings are extensively used in consumer and industrial applications including compositions containing non-metallic additions such as phosphorus and boron. Various patent filings disclose crystalline metal alloy coatings containing phosphorus and boron in various forms and concentrations:

Palumbo et. al. in U.S. Pat. No. 5,538,615 (1996) disclose a plating process for the repair of nuclear steam generator tubes by in-situ electroforming a metallic structural layer on the inside of the degraded metal tube section. The electrosleeve is applied by a convenient remote process forming a structural layer on the inside of the affected tube section. The inner diameter of the tube to be repaired is at least 5 mm, but typically between 1 cm and 5 cm. The repaired metal tube section has an electroformed structural layer which has an ultrafine grain microstructure of sufficient thickness to restore the degraded section to at least to its original mechanical specifications.

The fine grained, highly twinned microcrystalline structure of a nickel layer contains between 400-4,000 ppm of phosphorous as a pinning agent to enable continuous operation in heat exchanger tubes, such as nuclear steam generator tubes, which typically operate at temperatures of about 300° C. without deterioration or softening induced by grain growth.

Tajiri et. al. in U.S. Patent Publication 2020/0190650 (issued as U.S. Pat. No. 11,053,577 (2021)) disclose a nickel-cobalt material and method for forming a doped nickel-cobalt precursor material using phosphorous or boron additions as pinning agents. The method also includes heat-treating the doped nickel-cobalt precursor material below the onset temperature for grain growth, specifically between 600 and 750K (327° C. and 477° C.), to form a heat-treated nickel-cobalt material. Heat-treating forms phosphorous precipitates at nanocrystalline grain-boundaries.

Tajiri et. al. in U.S. Patent Publication 2020/0291508 disclose nickel-cobalt materials and methods for thermally stabilizing them. The nickel-cobalt material may include a metal matrix composite with amorphous regions and crystalline regions substantially encompassed by a nanocrystalline grain structure with a grain-size distribution of about 50 nm to about 800 nm. The metal matrix composite is composed of nickel, cobalt, and a dopant such as phosphorus, sulfur and/or boron. The nickel-cobalt material is heat treated within a first temperature zone below the onset temperature for grain growth and then within a second temperature zone above the onset temperature for grain growth in the material to thermally stabilize the material. According to Tajiri '508, the phosphorus containing dopant is phosphorous which is deposited during the electrodeposition process and dispersed through the crystalline lattice of the nickel-cobalt alloy.

Palumbo et. al. in U.S. Patent Publication 2003/0234181 disclose a process for repairing an external surface area of a degraded section of metallic workpieces, especially of tubes and tube sections. Suited electrodeposited metallic coatings contain one or more metals selected from the group consisting of Ag, Au, Cu, Co, Cr, Ni, Fe, Pb, Pd, Pt, Rh, Ru, Sn, Mo, Mn, W, V, and Zn, and additional alloying elements can be selected from the group consisting of B, C, P, S and Si, and can optionally comprise metal matrix composites containing metal powders, metal alloy powders, metal oxides, nitride powders, carbon powders, carbide powders, diamond powders, $MoS_2$ and organic material additions. Working examples disclosed, among others, include grain-refined alloys containing phosphorus additions, including Ni-0.15P (average grain-size: 200 nm, hardness: 300 VHN), Ni-0.2P (average grain-size: 70 nm, hardness: 400 VHN) and Ni-0.6P (average grain-size: 13 nm, hardness: 780 VHN).

Palumbo et. al. in U.S. Patent Publication 2005/0205425 disclose a process for forming coatings or free-standing deposits of nanocrystalline metals, metal alloys or metal matrix composites with grain-sizes below 1,000 nm. Suitable electrodeposited metallic coatings contain (a) a pure metal or alloys of metals selected from the group consisting of Ag, Au, Cu, Co, Cr, Ni, Fe, Pb, Pd, Pt, Rh, Ru, Sn, V, W, Zn, or (b) an alloy containing at least one of the elements of group (a) and alloying elements selected from the group consisting of C, P, S and Si. Working examples disclosed, among others, include alloys containing phosphorus additions, including Ni-(amorphous, hardness: 611 VHN) and Ni-5.9P with 45% per volume $B_4C$ (average grain-size: 12 nm, hardness: 609 VHN).

Palumbo et. al. in U.S. Pat. No. 7,553,553 (2009), assigned to the same assignee as the present application, disclose lightweight articles comprising a polymeric material at least partially coated with a fine-grained metallic material. The fine-grained metallic material has an average grain-size between 2 nm to 5,000 nm, a hardness between 200 VHN and 3,000 VHN, and modulus of resilience between 0.25 to 25 MPa. Several suitable metal deposition processes can be applied to establish high-strength coatings of pure metals or alloys of metals selected from the group of Ag, Al, Au, Cu, Co, Cr, Ni, Sn, Fe, Pt, Ti, W, Zn and Zr and alloying elements selected from Mo, W, B, C, P, S and Si and metal matrix composites of pure metals or alloys with particulate additives such as powders, fibers, nanotubes, flakes, metal powders, metal alloy powders and metal oxide powders of Al, Co, Cu, In, Mg, Ni, Si, Sn, V, and Zn; nitrides of Al, B, Si and Ti, and various forms of carbon C, and carbides of B, Cr, Bi, Si, Ti, W, and self-lubricating materials such as $MoS_2$ or organic materials such as PTFE. Working examples disclosed, among others, include electrodeposited alloys containing phosphorus additions, including Co-2-3% P (average grain-size: 15 nm) and Ni-0.6P (average grain-size: 13 nm, hardness: 780 VHN).

Palumbo et. al. in U.S. Pat. No. 8,129,034 (2012), assigned to the same assignee as the present application, disclose free-standing articles containing fine-grained (average grain-size 1 nm to 1,000 nm) metallic coatings optionally containing solid particulates dispersed therein on various substrates. The electrodeposited coating has a low coefficient of thermal expansion (CTE) matching the CTEs of the substrate to minimize dimensional changes during thermal cycling and prevent premature failure. The fine-grained metallic coating is selected from the group consisting of (i) a pure metal selected from the group consisting of Al, Cu, Co, Ni, Fe, Mo, Pt, Ti and Zr, (ii) an alloy comprising at least two elements selected from the group consisting of Al, Cu, Co, Ni, Fe, Mo, Pt, Ti and Zr; (iii) pure metals or an alloy comprising at least one element selected from the group consisting of Al, Cu, Co, Ni, Fe, Mo, Pt, Ti and Zr, further comprising at least one element selected from the group consisting of Ag, Au, B, C, Cr, Mo, Mn, P, S, Si, Pb, Pd, Rh, Ru, Sn, V, W, and Zn; and (iv) any of (i), (ii) or (iii) wherein said fine-grained metallic coating also comprises particulate additions in the volume fraction of between 0 and 95% by volume. Working examples disclosed, among others, include electrodeposited alloys containing phosphorus additions, including Ni-0.6P (average grain-size: 13 nm, hardness: 780 VHN as plated, 890 VHN after heat-treatment at 400° C. for 20 minutes and 1010 VHN after heat-treatment by 400° C. for 20 minutes, followed by another heat-treatment at 200° C. for 11 hours) and Co-0.8P (average grain-size: 12 nm, hardness: 580 VHN).

Gonzalez et. al. in U.S. Pat. No. 8,663,819 (2014), assigned to the same assignee as the present application, disclose free-standing articles or articles at least partially coated with substantially porosity free, fine-grained and/or amorphous Co-bearing metallic materials optionally containing solid particulates dispersed therein. The electrodeposited metallic layers and/or patches comprising Co provide, enhance or restore strength, wear and/or lubricity of substrates without reducing the fatigue performance compared to either uncoated or equivalent thickness chromium coated substrates. The fine-grained and/or amorphous metallic coatings comprising Co are particularly suited for articles exposed to thermal cycling, fatigue and other stresses and/or in applications requiring anti-microbial properties. Preferred electrodeposited metallic layers comprise cobalt and phosphorus, e.g., alloys of cobalt and P with unavoidable impurities; and cobalt and phosphorus alloys further containing at least one element selected from the group consisting of B, C, H, O, W, Fe, and S.

Tomantschger et. al. in U.S. Pat. No. 8,906,515 (2014), assigned to the same assignee as the present application, disclose metal-clad polymer articles containing structural fine-grained and/or amorphous metallic coatings/layers optionally containing solid particulates dispersed therein. The fine-grained and/or amorphous metallic coatings are particularly suited for strong and lightweight articles, precision molds, sporting goods, automotive parts and components exposed to thermal cycling although the coefficient of linear thermal expansion (CLTE) of the metallic layer and the substrate are mismatched. The interface between the metallic layer and the polymer is suitably pretreated to withstand thermal cycling without failure. The fine-grained metallic coating is selected from the group consisting of (i) one or more metals selected from the group consisting of Ag, Al, Au, Co, Cr, Cu, Fe, Ni, Mo, Pd, Pt, Rh, Ru, Sn, Ti, W, Zn and Zr, (ii) pure metals selected from the metals listed in (i) or alloys containing at least two of the metals listed in (i), further containing at least one element selected from the group consisting of B, C, H, P and S; and (iii) any of (i) or (ii) where said metallic coating also contains particulate additions in the volume fraction between 0 and 95% by volume. Working examples disclosed, among others, include alloys galvanically deposited containing phosphorus additions. As is commonly recognized, Ni and/or Co alloys with phosphorus, when the P content exceeds about 4-6%, as deposited are amorphous, including Ni-7P and are not of interest in this application, however, one example discloses the use of nanocrystalline Co-2P (average grain-size: 15 nm).

Tomantschger et. al. in U.S. Pat. No. 9,005,420 (2015), assigned to the same assignee as the present application, disclose a variable property deposit, at least partially of fine-grained metallic material, optionally containing solid particulates dispersed therein. The electrodeposition conditions in a single plating cell are suitably adjusted to once or repeatedly vary at least one property in the deposit direction. In one embodiment denoted multidimensional grading, property variation along the length and/or width of the deposit is also provided. In Example 8 an electrolyte solution and plating conditions are described to electroplate a three layer deposit containing a nanocrystalline Ni layer, an amorphous Ni-5.6P alloy layer and finally, a nanocrystalline Ni-5.6P metal matrix composite layer which contains inclusions of 45% per volume of $B_4C$ deposited by using only one electroplating tank.

Tomantschger et. al. in U.S. Pat. No. 9,970,120 (2018), assigned to the same assignee as the present application, disclose a method for electrodepositing a coating/free-standing layer on a workpiece in an electrolytic cell while moving the workpiece and an anode applicator tool having a consumable anode insert relative to each other. Working examples provided include a commercial electrolyte for depositing fine-grained Co—P alloys available from Integran Technologies Inc. (Toronto, Ontario, Canada—the assignee) containing $H_3PO_3$ (phosphorous acid) as the P source to electroplate while avoiding the anodic oxidation of $PO_3^{3-}$ ($[PO_3]^{3-}$-phosphorous ion) to $PO_4'''$ ($[PO_4]^{3-}$-orthophosphate ion) and coatings containing Co-1.12-1.41P, Co-0.1-0.9P and Ni—P alloys are disclosed.

Caballero in U.S. Pat. No. 5,314,608 (1994) describes electrodeposited nickel-cobalt-boron alloys consisting of about 49-74% nickel, about 24-49% cobalt, and about 1.9-2.5% boron. Specifically, a dense, smooth, ductile, hard, highly reflective, corrosion-resistant, temperature resistant, and wear-resistant crystalline alloy of nickel, cobalt and boron is disclosed using a pulsed square wave current in an electrolytic bath containing nickel ions, cobalt ions, complexing agents, and an amino borane compound.

Tomantschger in U.S. Pat. No. 12,529,160 (2026), describes articles comprising isotropic and anisotropic electrodeposited layers of fine-grained alloys of Co, Cu, Fe, Ni and/or Zn with minor additions of boron (B), phosphorus (P), oxygen (O) and sulfur(S) that provide high strength, ductility and heat-resistance. Various suited electrodeposition processes and apparatuses for making the articles are disclosed as well.

Thus, as indicated by the prior art, there is a particular need for articles containing an adherent, durable, and thermally stable metallic coating. Similarly, there is a need for durable, free-standing metallic materials.

SUMMARY OF THE INVENTION

A variety of articles made of metallic materials, comprising a grain-refined microstructure, is used in conditions where, at times, the articles are subjected to brief or prolonged exposure to elevated temperatures. It is known that grain-refined metallic materials subjected to elevated temperatures may experience irreversible grain-growth leading to permanent softening and loss of the mechanical properties. Consequently, means of stabilizing the grain structure to maintain the excellent mechanical properties of grain-refined materials at elevated temperatures are being sought.

The inventors of the present disclosure have recognized that selected properties desired of metallic materials with a grain-refined microstructure, comprising at least one element selected from the group consisting of Co, Cu, Fe, Ni and Zn, can be substantially enhanced by additions of between 50-20,000 ppm (per weight) of at least one element selected from the group consisting of boron (B), phosphorus (P), oxygen (O) and sulfur (S) to increase the maximum temperature at which irreversible grain-growth occurs.

It is an objective of the present invention to provide metallic materials, comprising a grain-refined microstructure, containing at least one metallic element, preferably at least two metallic elements and more preferably at least three metallic elements selected from the group consisting of Co, Cu, Fe, Ni and Zn. The metallic materials further contain minor additions of at least one non-metallic element, preferably at least two non-metallic elements and more preferably at least three non-metallic elements selected from the group consisting of B, O, P and S.

It is an objective of the present invention to provide metallic materials, comprising a grain-refined microstructure, containing at least two or three elements selected from the group consisting of Co, Cu, Fe, Ni and Zn, with each metallic element present containing at least 5% per weight, preferably at least 7.5% per weight, more preferably at least 10% per weight and most preferably at least 20% per weight and up to 95% of each metallic element. Each metallic element comprises a maximum content of 50% per weight, a maximum of 60% per weight, a maximum of 70% per weight, a maximum of 80% per weight, a maximum of 90% per weight and up to 95% of the metallic material.

It is an objective of the present invention to provide grain-refined metallic materials that contain combined additions of non-metallic elements of between 100 and 20,000 ppm (0.01-2.0% per weight), preferably between 250 and 15,000 ppm (0.025-1.5% per weight), and most preferably between 1,000 and 10,000 ppm (0.1-1.0% per weight) of at least one, or two, or three elements selected from the group consisting of boron (B), phosphorus (P), oxygen (O) and sulfur (S) to increase the maximum temperature at which irreversible grain-growth occurs.

It is an objective of the present invention to provide grain-refined metallic materials that contain additions of between 1,000-20,000 ppm (0.1-2.0% per weight) of P and/or B, additions of up to 350 ppm or in excess of 3,000 ppm O, and additions of between 300 ppm and 750 ppm of S. Unlike in the prior art, in this invention phosphorus (P) and oxygen (O) are not present in the metallic material as a "phosphorous compound" (i.e., $[PO_3]^{3-}$), in which the molar ratio between P and O is 1:3, and P has an oxidation state of +III.

It is another objective of the present invention to provide grain-refined metallic materials which, as deposited and after heat-treatment, are low and preferably free of phosphorous and/or phosphite, i.e., the total phosphorous and/or phosphite content is less than 90 ppm, more preferably less than 80 ppm, more preferably less than 75 ppm, more preferably less than 50 ppm and most preferably 0 ppm.

It is a further objective of the present invention to provide grain-refined metallic materials containing at least two non-metallic elements selected from the group consisting of B, P, O and S wherein, in the case of P-alloys, the other non-metallic element additions do not contain B and, in the case of B-alloys, the other non-metallic element additions do not contain P.

It is an objective of the present invention to provide grain-refined metallic materials that, as deposited, contain additions of B, O, P and S that are located in the grains preferably (with the exception of oxygen) in elemental form as alloying elements as well as at the grain-boundaries.

It is an objective of the present invention to provide grain-refined metallic materials that contain additions of elemental B, P and/or S having an oxidation state of zero (0), as opposed to being present as a B compound having an oxidation state of I and III, as opposed to being present as a P compound having an oxidation state of I, II, III or V and a S compound having an oxidation state of -II, II, II, IV and VI.

It is an objective of the present invention to provide grain-refined metallic materials containing additions of oxygen with an oxidation state of -II being typically present as a (partial) metal compound, i.e., a metal oxide $MeO_x$ or a metal oxi-hydroxide $MeO_xH_y$, with x and y typically <1.

It is an objective of the present invention to provide metallic materials, comprising a grain-refined microstructure, having an average grain-size of ≤1,000 nm, preferably between 2 and 1,000 nm, more preferably between 10 and 750 nm, and most preferably between 25 and 500 nm.

It is a further objective of the present invention to provide metallic materials in embodiments which comprise multiple nanometer thick layers that periodically vary in composition and/or average grain-size, electrodeposited from the same electrolyte while suitably varying the electroplating parameters. Such nano-laminates comprise at least 100, preferably at least 1,000 ultra-thin individual layers which may periodically be repeated in a stack forming the electrodeposited metallic layer using a predetermined sequence.

It is an objective of the present invention to provide structurally and/or compositionally modulated grain-refined metallic materials consisting of a plurality of layers forming nano-laminates, wherein each of said layers has a thickness in a range selected independently from about 5 nm to about 250 nm, preferably between 5 nm and 100 nm, each of the directly adjacent sub-layers varying in composition of at least one metallic alloying element and/or by at least one of the non-metallic alloying elements by at least 5%, preferably at least 10% and/or an average grain-size and/or ductility by at least 10%, preferably at least 25%.

It is an objective of the present invention to provide metallic materials, comprising a grain-refined microstructure, which, in the as-deposited condition without an additional heat-treatment, depending on the composition, are capable of operating at temperatures of up to 100° C., preferably up to 200° C., preferably up to 300° C., more preferably up to 350° C. and most preferably up to up to 400° C. before a noticeable grain growth occurs, which is defined herein as a loss of hardness of ≥10% when compared to the hardness of the original material, e.g., as electrodeposited.

It is an objective of the present invention to provide grain-refined metallic materials which are capable of operating at elevated temperatures "as deposited", i.e., without the need to expose them to a special "pinning" heat-treatment prior to use as described in the prior art.

It is also an objective of the present invention to provide metallic materials comprising a grain-refined microstructure which, after electrodeposition, are exposed to an optional annealing heat-treatment to further optimize the microstructure and change the mechanical or electrical properties. Annealing is performed preferably in an inert atmosphere (nitrogen, argon) or in a vacuum or even air to increase or reduce hardness, increase ductility and thermal stability, and help minimize internal stresses. Annealing is performed at a temperature range between 10% and 60%, preferably between 20% and 50%, more preferably between 30% and 40% of the melting temperature expressed in Kelvin of the metallic material. Depending on the desired properties, rapid cooling or slow cooling can be employed when removing the metallic materials from the annealing furnace to further influence/optimize the mechanical properties, e.g., in the case of Ni—Co alloys, the annealing heat-treatment can be performed at temperatures between 100° C. and 800° C., preferably between 200° C. and 650° C., and preferably between 300° C. and 450° C., It is an objective of the present invention to provide metallic materials, comprising a grain-refined microstructure, having a minimum ductility of the electrodeposit (% elongation in tension) of 1%, preferably 2.5%, more preferably 5.0%, and most preferably 7.5%.

The present invention describes grain-refined metallic material compositions that comprise boron, phosphorus and sulfur predominantly as alloying agents present with the oxidation state zero (0), as opposed to metallic material compositions, classified herein as metal matrix composites, that contain inorganic phosphorus compounds as precipitates (such as phosphates, phosphorous, phosphites and hypophosphites) with the oxidation state+V, +III or +I solely at the grain-boundaries of the metal alloy to serve as pinning agents.

It is an objective of the present invention to provide strong, ductile, durable, scratch and abrasion resistant, strong, lightweight articles for use in various applications including, but not limited to, transportation applications (including automotive, aerospace, ships and other vessels navigating on land, in air, space and on water, and their components), defense applications, industrial components including, but not limited to, on-shore and off-shore oil and gas exploration and production, building materials, consumer and commercial products, electronic equipment or appliances and their components, sporting goods as well as any other indoor or outdoor equipment which are, at least at times, exposed to above ambient temperatures.

It is an objective of this invention to provide grain-refined metallic materials in free-standing form or as coated articles on suitable permanent substrates.

It is an objective of this invention to provide grain-refined metallic materials in the form of coated articles on metallic material substrates including, but not limited to, Al, Co, Cu, Fe, Ni, Sn, Ti and Zn and their alloys, and/or polymeric material substrates including, but not limited to, ABS, PVC, polyolefins, polyamides, peeks and carbon fiber composites.

Another objective of the invention is to provide a process to pre-treat a temporary or permanent polymer substrate suitably to render it sufficiently electrically conductive for electroplating by applying at least one metallization layer with a maximum thickness of the of 15 μm, preferably 10 μm, preferably 5 μm and more preferably 2.5 μm.

It is an objective of the present invention to provide one or more metallizing layers, each having a layer thickness in the range of between 1 μm and 5 μm, preferably between 5 μm and preferably between 10 μm and 50 μm, and more preferably between 15 μm and 75 μm.

It is an objective of the present invention to provide grain-refined metallic materials in the form of coated articles for a variety of applications operating at ambient temperatures and/or at elevated temperatures of up to 100° C., preferably up to 200° C., preferably up to 300° C., preferably up to 350° C., preferably up to 500° C. and preferably up to 800° C. or even higher, but not limited to:

- aerospace parts and components including, but not limited to, wings, wing parts including flaps and access covers, rudders, covers, structural spars and ribs, parts of propellers and jet engines parts including, but not limited to, propellers, rotors and rotor blades, stators and stator vanes, fuselage parts, manifolds, various fluid conduits, heat exchanger parts, nose cones, and landing gear parts;
- automotive components including, but not limited to, heat shields, oil, transmission and brake parts, fluid tanks and exposed housings including oil and transmission pans, spoilers, grill-guards and running boards, vehicle chassis parts including hood, doors and side panels, gas tanks and engine covers;
- sporting goods including, but not limited to, hockey sticks, skate blades, helmets, face masks, golf shafts, heads, balls and faceplates, ski and snowboard components including bindings, and bicycle parts;
- industrial/consumer products and parts including, but not limited to components used in the oil and gas as well as mineral exploration, production and refining industry, bolts and fasteners, face masks, solar panels, turbines and windmills; and
- all components requiring a heat-resistant and corrosion resistant coating.

Accordingly, in one embodiment, the present invention provides for an article comprising an electrodeposited metallic alloy layer or patch consisting of:

(i) A microcrystalline grain structure with an average grain-size in the range of 2 to 1,000 nm;
(ii) at least two metallic elements selected from the group consisting of Co, Cu, Fe, Ni and Zn;
(iii) each of said metallic elements comprising at least 5% per weight of the metallic material;
(iv) at least one non-metallic element selected from the group consisting of B, O, P and S;
(v) said non-metallic elements in total comprising between 50 ppm and 10,000 ppm per weight of the metallic material;
(vi) wherein the hardness of said electrodeposited metallic material after heat-treatment for 12 hours at a temperature of 100° C. in an inert atmosphere retains at least 90% of the as-deposited hardness.

In another embodiment, the present invention provides for an article comprising an electrodeposited metallic material consisting of:

(i) at least one metallic layer having a microcrystalline grain structure with an average grain-size in the range of 2 to 1,000 nm;
(ii) metallic elements including Co and Ni combined comprising at least 95% per weight of the metallic alloy layer;
(iii) at least one non-metallic element selected from the group consisting of B, O, P and S;
(iv) the non-metallic elements in total comprising between 50 ppm and 10,000 ppm per weight of the metallic alloy layer; and
(v) wherein the hardness of said electrodeposited metallic material after heat-treatment for 12 hours at a temperature of 200° C. in an inert atmosphere retains at least 90% of the as-deposited hardness.

The following further defines the article of the invention:

Free-Standing Article Specification:

In one embodiment the grain-refined metallic layer is applied to a temporary substrate which defines the size and the shape of a free-standing article and, after electrodeposition, the metallic layer is separated from the substrate or the substrate is melted, dissolved, decomposed or otherwise removed, to form a free-standing metallic article.

Coating on Permanent Substrate Specification:

In one embodiment the grain-refined metallic layer is applied to a metallic material. Typical metal- and alloy-substrates used comprise at least one element selected from the group consisting of Al, Co, Cr, Cu, Fe, Mg, Ni, Sn, Ti, W, Zn, and Zr.

In another embodiment the grain-refined metallic layer is applied to a polymeric material comprising at least one of: (i) thermosets such as unfilled or filled epoxy, phenolic or melamine resins, polyester resins, and urea resins; (ii) thermoplastic polymers such as thermoplastic polyolefins (TPOs) including polyethylene (PE) and polypropylene (PP), polyamides, polyphthalamides, polyphtalates, polystyrenes, polysulfones, polyimides, polybutadienes, polyisoprenes, butadiene-styrene copolymers including acrylonitrile-butadiene-styrene (ABS), poly-ether-ether-ketone (PEEK), polycarbonates, and chlorinated polymers such polyvinyl chloride (PVC).

Filler additions can include metals, metal oxides, carbides, carbon (carbon, carbon fibers, carbon nanotubes, diamond, graphite, graphite fibers and graphene), glass, glass fibers, fiberglass, metallized fibers such as metal coated glass fibers, mineral/ceramic fillers such as talc, calcium silicate, silica, calcium carbonate, alumina, titanium dioxide, ferrite, mica and mixed silicates (e.g., bentonite or pumice).

Substrates/base articles are made or shaped by any convenient manufacturing process. It is desirable to suitably prepare a surface of the substrates/base article before it receives the grain-refined metallic layer. The pretreatment can involve a cleaning step followed by a suitable mechanical or chemical process which increases the surface roughness and enhances adhesion between the permanent substrate and the metallizing layer.

Optional Polymeric Coating Specification:

Optionally, a decorative polymeric top-coat, e.g. paint, or a functional polymeric coating, e.g., hydrophobic and/or icephobic coatings can be applied to the grain-refined metallic layer which does not deteriorate at the maximum operating temperature the article is exposed to. The polymeric coating can contain a curable resin which can be any thermoset resin that can be cured or "set" by crosslinking.

The polymeric coating can also contain an elastomer such as any alkadiene polymer, e.g., neoprene rubber; isoprene rubber; butadiene rubber, polyurethane and the like. Modified epoxies containing rubber or silicone adducts are also suitable.

The polymeric coating can be fiber reinforced. Examples of reinforcing fibers include glass fibers, aramid fibers, carbon fibers, carbon nanotubes, and the like. Other additives can include fluorinated polymers such as polytetrafluoroethylene (PTFE) or fluorinated silicones as well as pigments to provide a coating with any desired color. In general, the resin compositions used for forming the polymeric coating can be cured at temperatures below 150° C. including at room temperature.

Heat-Treatment Test Specification:

In order to quickly and reliably assess the effect of the metallic layer composition on the temperature stability a simple, reproducible heat-treatment test is required. It is well known that in the grain-size range of interest (10-1,000 nm average grain-size) there is a linear relationship between the hardness, as e.g., the Vickers hardness measured by indentation, and the inverse square-root of the average grain-size according to the Hall-Petch equation. When the average grain-size increases, e.g., due to grain-growth induced by heat-treatment, the hardness of the material drops accordingly.

It is also known that the average grain-size measurement can depend on the method used for its determination and can be affected by a number of factors such as internal stress and texture. Therefore, measuring the hardness of a sample of sufficient thickness by indentation is a simple and reliable method of keeping track of the physical characteristics of a sample and directly relate to the average grain-size and strength.

Accordingly, a convenient and reliable heat-treatment procedure has been developed and used throughout this work to assess the temperature stability, in which test specimens are exposed to a temperature in the range of about 20-50% of the melting point in Kelvin of the metallic material. Accordingly, an annealing temperature of 350° C. (623K) for 12 hours in an inert atmosphere (vacuum, nitrogen, helium or argon) can be used for metallic alloys having a total combined Ni, Co and Fe content of at least 50% per weight. The heat-treatment temperature may be adjusted, e.g., in the case of metallic materials with a high Cu content (≥50% per weight) the heat-treatment may be performed at 200° C. (473K) for 12 hours and in the case of metallic materials with a high or Zn content (≥50% per weight) the heat-treatment may be performed at 100° C. (373K) for 12 hours. The Vickers hardness before, i.e., as deposited, and after, i.e., after the heat-treatment, is measured by indentation at room temperature, and the hardness and any change in hardness are recorded.

As many electroplating operations are already equipped for annealing electroplated parts to prevent hydrogen embrittlement, a convenient heat-treatment test can be performed between 175 and 200° C. for between 12 and 24 hrs for all alloys but those containing more than 50% Zn, e.g. 12 hrs at 200° C.

As outlined above, one the goal of the present disclosure is to electrodeposit grain-refined Co, Cu, Fe, Ni and Zn containing metallic materials with minor additions of non-metallic alloying agents (B, O, P, and S) which, after being exposed to 12 hrs at a temperature equivalent to about 35%, or between about 20% and 40% of the melting point of the metallic material expressed in Kelvin in an inert atmosphere, retain at least 90% of their as deposited hardness.

Definitions:

As used herein, the term "metal", "alloy" or "metallic material" means crystalline and/or amorphous structures where atoms are chemically bonded to each other and in which mobile valence electrons are shared among atoms. Metals and alloys are electronic conductors; they are malleable and lustrous materials and typically form positive ions. Metallic materials include alloys of Co, Cu, Fe, Ni and Zn with minor additions of P, S, O and/or B.

As used herein, the term "metal compound" refers to a chemical compound that can contain one or more metallic elements bonded to one or more non-metallic elements. Typically, the metal atom has a positive charge and acts as the cation, typically having a positive valence and not zero (0) as a metallic material. The metal cation in the compound is bonded to a nonmetallic anion, typically an anion having a negative valence, e.g., a halide. Metal oxides such as CuO or metal salts such as $CuCl_2$, $Cu(NO_3)_2$, $CoSO_4$, $CoCl_2$, $CoHPO_3$, $Ni_3(PO_3)_2$, $FePO_4$, $ZnCl_2$ and the like are metal compounds which are not considered a metallic material within the context of this invention. Metal compounds can be soluble or insoluble in electrolyte solutions used in electrodeposition.

As used herein the term "chemical composition" means the chemical composition of the electrodeposited material.

As used herein the term "phosphorus" refers to the chemical element with the symbol P having the atomic number 15 and a valence of zero (0).

As used herein the terms "phosphoric acid" and "orthophosphoric acid" refer to a weak acid with the chemical formula $H_3PO_4$ with phosphorus having a valence of +V.

As used herein the terms "phosphate" and "phosphate-ion" refer to an anion with the chemical formula $[PO_4]^{3-}$ with phosphorus having a valence of +V.

As used herein the term "phosphorous acid" refers to a weak acid with the formula $H_3PO_3$ with phosphorus having a valence of +III.

As used herein the term "phosphite" and "phosphite-ion" refer to anions with the chemical formula $[HPO_3]^{2-}$ or $[H_2PO_3]^-$ with phosphorus having a valence of +III wherein the hydrogen atom is not acidic, being bonded to phosphorus rather than oxygen.

As used herein "phosphorous" and "phosphorous-ion" refer to a chemical composition containing the element phosphorus with a valence or oxidation number of +III, more specifically three oxygen atoms are bound to one phosphorus atom according to the chemical formula $PO_3'''$ (i.e., $[PO_3]^{3-}$).

As used herein the term "phosphorous-free", refers to a material with a phosphorous content of less than 90 ppm, more preferably less than 80 ppm, more preferably less than 75 ppm, more preferably less than 50 ppm and most preferably 0 ppm.

As used herein "hypophosphomus acid" and "phosphinic acid" refer to a weak acid with the chemical formula $H_3PO_2$ with phosphorus having a valence of +I which is an even more powerful reducing agent than $H_3PO_3$. Salts derived from $H_3PO_2$ are called hypophosphites.

As used herein, the term "metal matrix composite" (MMC) is defined as particulate matter embedded in a metallic material matrix that typically do not participate in the electrochemical reactions taking place during the electrodeposition process at the workpiece surface. Particulates additions typically are inert powders added to the electrolyte solution where they get suspended which, when in close proximity to the workpiece surface, can become attached to the workpiece surface, get overplated and thereby become trapped and incorporated in the electrodeposited layer as its thickness increases. Particulates can also be formed in-situ in the electrolyte and/or the workpiece surface by a chemical reaction, e.g., between phosphite and/or phosphorous ions and other ions such as metal ions present in the bath. MMCs can be produced by electrodeposition by suspending particles or adding soluble materials to the electrolyte solution which precipitate at the cathode forming insoluble compounds which are incorporated in the electrodeposited metallic layer deposit by inclusion, e.g., typically at grain-boundaries, but they do not form an alloy with the metallic material. To distinguish the particulate content in a MMC from the alloy composition the particulate content herein is typically expressed in volume percent as frequently, e.g., in the case of hardness and wear performance the volume fraction of the particulates dictates the MMC performance. In contrast, the chemical composition of the alloys herein is typically reported in weight percent, unless otherwise indicated.

As used herein "coarse-grained" defines a metallic microstructure having an average grain-size greater than 1 micron and up to 500 micron.

As used herein "fine-grained" or "grain-refined" is defined as a metallic microstructure having an average grain-size between 2 nm and 1,000 nm.

As used herein "amorphous" defines a metallic microstructure lacking crystallinity characterized by a pattern of constituent atoms or molecules which do not repeat periodically in the three dimensions.

As used herein, the term "grain-size" refers to a size of a set of constituents or components, e.g., the crystallites, included in a material, such as a nanostructured metallic material. Grains/crystallites are attached to each other and are separated by grain-boundaries and grains/crystallites are not equivalent to particles, which are independent "unattached" structures and/or forming "inclusions", defined by their particle size.

As used herein, the term "particle-size" refers to the size of a free-flowing powder, or granular material, including the particle size of particulate inclusions found in MMCs or wherever distinct particles are found not connected to each other by grain-boundaries.

As used herein, the term "substrate" as used herein means a structural member or product that can be used as a base for an article.

As used herein, the term "permanent substrate" refers to a structural member or product that is used as the base for an article that the metallic coating is applied to and that remains attached during its intended use to form a metal-clad article.

As used herein, the term "temporary substrate" refers to a temporary member or product that is used as the base to define the shape and size of an article that the metallic coating is applied to during the electrodeposition process and which, after the metallic coating is applied, is removed and the temporary substrate is no longer present during the intended use of the article.

As used herein, the term "electrically conductive" refers to materials such as metals, graphite and conductive polymers which have an electrical conductivity of at least 10 S/m at (Nylon: ~10-12 S/m, typical polymers <1 S/m, conductive polymers: $10^4$-$10^6$ S/m, graphite: $10^5$ S/m, metals: $>10^7$ S/m).

As used herein, the term "metallic coating" or "metallic layer" means a metallic deposit/layer comprising a metallic material applied to part of or the entire exposed surface of an article.

As used herein, the term "coating thickness" or "layer thickness" refers to depth in a deposit direction.

As used herein, the term "homogeneous layer" refers to a structure that does not change in chemical composition and/or other properties throughout."

As used herein, the term "heterogeneous layer" or "graded layer" refers to a structure where the chemical composition and/or other properties such as the physical structure (thickness, microstructure, etc.) varies through its depth and/or length by at least 10%.

As used herein the term "laminate" or "nano-laminate" means a metallic coating that includes a plurality of adjacent metallic layers, each having an individual layer thickness between 1.5 nm and 5 micron. A "layer" means a single thickness of a substance where the substance may be defined by a distinct composition, microstructure, phase, grain-size, physical property, chemical property or combinations thereof. It should be appreciated that the interface between adjacent layers may not necessarily be discrete but may be blended, i.e., the adjacent layers may gradually transition from one of the adjacent layers to the other of the adjacent layers.

As used herein, the terms "metal-coated article", "laminate article" and "metal-clad article" mean an item which contains at least one permanent substrate material covered, at least in part, by a metallic layer or patch. In addition to the metallic layer, one or more intermediate structures, such as metalizing layers and polymer layers including adhesive layers, can be employed between said metallic layer or patch and said substrate material.

As used herein, the term "bonding layer", as used herein, refers to an intermediate layer directly adjacent to the substrate and between the substrate and the outermost coating layer exposed to the elements of the article of manufacture.

As used herein, "exposed surface" and "outer surface" refer to all accessible surface area of an object accessible to the atmosphere and/or a liquid. The "exposed surface area" refers to the summation of all the areas of an article accessible to a fluid.

As used herein, "surface roughness", "surface texture" and "surface topography" mean a regular and/or an irregular surface topography containing surface structures. These surface irregularities/surface structures combine to form the "surface texture".

As used herein the term "smooth surface" is characterized by a surface roughness (Ra) less than or equal to 1 micron.

As used herein, the term "substantially porosity-free," means the metallic coating which has a porosity of less than 1.5%.

As used herein "coating/layer internal stress" or "internal stress" or "residual stress" means an inherent force in an electrodeposit, which free from any external forces, causes the electrodeposit to be either "compressed" or "stretched". In the compressed stressed condition the deposit has the tendency to expand, whereas in the tensile stressed condition the deposit has the tendency to contract. High internal stresses, i.e., stresses equal to or exceeding 2.5 ksi (compressive or tensile) have heretofore been considered to be undesirable as they have been attributed to compromise the corrosion performance due to cracking and flaking and furthermore to also compromise fatigue strength.

As used herein "tensile stress", signified by a positive value, causes the plated strip to bend in the direction of the anode whereas "compressive stress", signified by a negative value, causes the plated strip to bend away from the anode.

As used herein "fatigue" is the progressive and localized structural damage that occurs when a material is subjected to cyclic loading and the "fatigue life" is the number of stress cycles that a specimen can sustain before failure.

As used herein "unavoidable impurities" refer to elements built into the metallic deposit originating from impurities present in the bath, i.e., substances not purposely added to or present in the electrolyte, e.g., bath chemical impurities (such as Ni in Co salts and Co in Ni soluble anodes), or substances inadvertently introduced into the bath (such as Cu from bus bar corrosion and Fe from corrosion of part-racks or tank liners). Unavoidable impurities also include compounds or elements formed by chemical and/or electrochemical reactions of, e.g., water, salts and/or organic substances present in the solution that are purposely added to the electrolyte for different purposes. Total unavoidable impurities typically amount to <1% of the metallic deposit.

As used herein the term "average cathode current" ($I_{avg}$) means the average applied current resulting in depositing the metallic material and is expressed as the means of the cathodic minus the reverse charge, expressed in mA×ms divided by the sum of the on-time, off-time and reverse time expressed in ms, i.e., $I_{avg}=(I_{peak}xt_{on}-I_{reverse}xt_{an})/(t_{on}\pm t_{an}\pm t_{off})$; where "x" means "multiplied by".

As used herein the term "forward pulse" means cathodic deposition pulse affecting the metallic deposit on the workpiece and "forward pulse on time" means the duration of the cathodic deposition pulse expressed in ms: $t_{on}$.

As used herein the term "off time" means the duration where no current passes expressed in ms: $t_{off}$.

As used herein the term "reverse pulse on time" means the duration of the reverse (=anodic) pulse: $t_{an}$.

As used herein "electrode area" means the geometrical surface area effectively plated on the workpiece which can be a permanent substrate or a temporary cathode expressed, e.g., in $cm^2$.

As used herein the term "average cathode current density" ($CD_{avg}$) means the average current $I_{avg}$ resulting in depositing the metallic material which is normalized with the effective workpiece area.

As used herein the term "peak forward current density" means the current density of the cathodic deposition pulse expressed in $mA/cm^2$: $CD_{peak}$ As used herein the term "peak reverse current density" means the current density of the reverse/anodic pulse expressed in $mA/cm^2$: $CD_{reverse}$ or $CD_{anodic}$.

As used herein the term "duty cycle" means the cathodic on time divided by the sum of all times (on time, off time and anodic time (also referred to as reverse pulse on time)).

As used herein the term "throwing power" is a measure of an electroplating solution's ability to plate to a uniform thickness over an irregularly shaped cathode.

BRIEF DESCRIPTION OF THE DRAWINGS

The features and advantages of the invention will be appreciated upon reference to the following drawing, in which:

FIG. 1 is a conceptual cross-sectional view of an exemplary article including a substrate coated with a plurality of metallic layers.

DETAILED DESCRIPTION OF THE INVENTION

It is well known that pinning agents located at grain-boundaries can be added to crystalline metallic materials to prevent the grain growth at elevated temperatures and/or to increase the operating temperature at which grain growth occurs.

Palumbo et. al. in U.S. Pat. No. 5,538,615 (1996), cited above, describe a fine grained, highly twinned microcrystalline structure of a nickel layer which contains between 400-4,000 ppm of phosphorous as a pinning agent to enable continuous operation in heat exchanger tubes, such as nuclear steam generator tubes, which typically operate at temperatures of about 300° C. without deterioration or softening induced by grain growth. In order to eliminate the temperature induced grain growth problem, the as-plated grain-size is stabilized by adding a grain boundary pinning agent. Preferably, the pinning (stabilization) agent is phosphorous or molybdenum. Phosphorous may be introduced into the electroformed layer by adding a chemical that releases phosphorous such as phosphoric acid or phosphorous acid or both to the electrolyte. Palumbo teaches that, for most applications, an electroformed metal comprising from 400 to 4,000 ppm by weight phosphorous achieves the desired grain-size stabilization.

Tajiri et. al. in U.S. Patent Publication 2020/0190650, cited above, disclose a nickel-cobalt precursor material using between 1,500 and 3,000 ppm by atomic weight of phosphorous or boron additions as pinning agents. After electrodeposition, Tajiri's material needs to be heat-treated within a temperature zone below the onset temperature for grain growth such as between 600 and 750K (327° C. to 477° C.), to achieve the desired properties.

In paragraph of Tajiri '650 the nickel-cobalt materials and components made, providing for improved fatigue resistance, strength, and thermal stability, are described. The enhanced fatigue resistance may be attributable at least in part to a phosphorous dopant, a level of cobalt in the nickel-cobalt alloy, or a heat-treatment performed upon the precursor material. The disclosure states that phosphorous additions are used for stabilization or pinning.

In of Tajiri '650 phosphorous precipitates, which are included within the nickel-cobalt materials, are described disclosing that the phosphorous precipitates 120 are located at the grain-boundaries 106 and illustrated in, e.g., FIG. 2 of Tajiri '650.

In of Tajiri '650 the phosphorous source for the electrodeposition bath is disclosed as including hypophosphorous acid or a hypophosphite salt, e.g., exemplary hypophosphite salts include sodium hypophosphite, potassium hypophosphite, nickel hypophosphite, or ammonium hypophosphite, or other hypophosphite salts of alkali or alkaline earth metals, as well as combinations of these.

Tajiri '650 does not provide information to demonstrate or explain to the person of ordinary skill in the art how phosphorous deposits in the Ni—Co-host lattice are obtained, however, Tajiri '650 discloses formulations ranging from 30-35 atomic percent cobalt and phosphorous from as low as 500 ppm by atomic weight to 3,500 by atomic weight of phosphorous, as deposited, the balance being nickel. Table 1 below converts the atomic percentages disclosed in Tajiri '650 to weight percent. The compositional range of Tajiri '650, when expressed in weight percent, accordingly, ranges between 30.1 and 35.1 weight % Co, between 0.0672 and 0.4698 weight percent $PO_3^{3-}$ (which translates into between 264 ppm and 1,842 ppm per weight of phosphorus (P) and between 408 ppm and 2,856 ppm of oxygen) with the balance being Ni ranging between 64.9 and 69.5 weight %. Tajiri '650 does not provide for any additional components in his material, i.e., the elements are limited to Ni, Co, P and O (apart from a formulation comprising boron instead of phosphorous). The compositions of Tajiri '650 comprising phosphorous can further be identified and characterized by the fixed oxygen (O) to phosphorus (P) weight ratio of about 1.55 (the O to P atomic ratio is fixed at 3/1), O and P are exclusively forming a phosphorous compound located at the grain-boundaries, O has an oxidation state of -II, and P has an oxidation state of III.

There does not seem to be agreement with respect to where minor non-metallic additions are located within the microstructure of a grain-refined Ni and/or Co alloy. Tajiri '650, relying on the negligible solid solubility of P (elemental or its compounds) in Ni and/or Co under equilibrium conditions, is suggesting phosphorous is confined solely to the grain-boundaries. During pulsed electrodeposition, as practiced by Integran Technologies Inc. of Mississauga, Ontario, Canada (the assignee of the present disclosure), which typically uses relatively high current densities, however, processing conditions can be maintained which are nowhere near equilibrium conditions. While not wishing to being bound by any theory, the inventors of the present Application hypothesize that, when using electroplating according to this Application, reduction and incorporation of minor non-metallic elements such as B, P and S can also occur on any free metal workpiece surface, i.e., both in the grains and at the grain-boundaries, in contact with and wetted by the electrolyte containing ions of the metal and the non-metallic elements available for cathodic reduction. The inventors suggest that, in the as-deposited condition, B, P and S may be present in metastable solid solutions in Ni and/or Co alloys. Once the as-deposited grain-refined layer is annealed, however, the thermal activation for segregation to the grain-boundaries is provided and upon annealing, the precipitation of second phase particles of P (B, S and the like) occurs and, only after a sufficient heat-treatment, those elements then may increasingly accumulate at the grain-boundaries.

Tajiri et. al. in U.S. Patent Publication 2020/0291508, also cited above, disclose a nickel-cobalt precursor material using, among other, phosphorus or boron additions as pinning agents or dopants. After electrodeposition, Tajiri '508's material needs to be initially heat-treated within a temperature zone below the onset temperature for grain growth such as between 600 and 750K (327° C. to 477° C.), followed by a second heat-treatment within a temperature zone above the onset for grain growth such as between 800K and 900K (527° C. to 627° C.) to thermally stabilize the material. The nickel-cobalt material contains between 30% and 50% per weight cobalt, and the concentration of the dopant is in the range of 1,000 ppm to about 2,500 ppm by weight.

In paragraph [0028] of Tajiri '508 a total of 40 suited dopants are listed, i.e., half of the stable elements (5 of which are inert gases) in the periodic system are identified to include aluminum, antimony, arsenic, boron, beryllium,

TABLE 1

Tajiri 650's composition range extremes compared to the present Invention:

| | Tajiri '650 Formulation 1 [atomic %] | Tajiri '650 Formulation 1 [weight %] | Tajiri '650 Formulation 2 [atomic %] | Tajiri '650 Formulation 2 [weight %] | This Invention [weight %] |
|---|---|---|---|---|---|
| Co | 30.00 | 30.05 | 35.00 | 35.09 | 5-95 |
| Ni | 69.65 | 69.48 | 64.95 | 64.85 | 5-95 |
| Cu | 0.00 | 0.00 | 0.00 | 0.00 | 5-95 |
| Fe | 0.00 | 0.00 | 0.00 | 0.00 | 5-95 |
| Zn | 0.00 | 0.00 | 0.00 | 0.00 | 5-95 |
| B (instead of $PO_3'''$ only) | 0.10 | 0.0183 | 0.15 | 0.0275 | 0.01-1.0 |
| $PO_3'''$ | 0.35 | 0.4698 | 0.05 | 0.0672 | 0, <75 ppm |
| P | | 0.1842 | | 0.0264 | 0.01-1.0 |
| O | | 0.2856 | | 0.0408 | 0.01-1.0 |
| O/P atomic ratio | 3 | 1.55 | 3 | 1.55 | no fixed ratio |
| S | 0.00 | 0.00 | 0.00 | 0.00 | 0.01-1.0 |
| Other Components | 0.00 | 0.00 | 0.00 | 0.00 | <1.0 |

cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium and particularly suitable dopants are identified to include phosphorous and/or boron. Tajiri 508's dopants comprise metals, non-metallic elements and chemical compounds.

In paragraph of Tajiri '508 the "precursor material", i.e., the term used for the electrodeposited metallic material upon removal from the electroplating solution, including a phosphorous dopant is described. According to Tajiri '508, during the electrodeposition process, the phosphorous dopant is deposited and dispersed through the crystalline lattice of the nickel-cobalt alloy. Heat treating the precursor material may form nickel-phosphorous and cobalt-phosphorous precipitate alloys. The nickel-phosphorous precipitates may include nickel phosphide ($Ni_3P$) and the cobalt-phosphorous precipitates may include cobalt phosphide ($Co_2P$). In Tajiri '508 some of the phosphorous alloys precipitate at grain-boundaries and/or migrate to grain-boundaries. According to Tajiri '508 such precipitates act to prevent the motion of grain-boundaries by exerting a pinning pressure which counteracts the driving force of the grain boundary, thereby inhibiting grain growth. Such pinning may inhibit grain growth during heat-treatment, which may increase formation of intragranular twinning, thereby allowing for heat-treatment that improves ductility while preserving tensile strength. Additionally, such pinning may inhibit grain growth under high temperature and/or high stress operating conditions, providing thermal stability for components formed of the phosphorous-doped nickel-cobalt alloy disclosed in Tajiri '508.

It is clear that Tajiri 508's materials always comprise phosphorous, i.e., phosphorous is present in the as-deposited, precursor material as evidenced in Example 1, Table 1, and phosphorous is still present after heat-treatment as evidenced in Example 3, Table 3. Therefore, in contrast to the material disclosed in the present Application, Tajiri 508's materials are never "phosphorous-free" and in paragraph [0052] Tajiri '508 discloses the concentration of the phosphorous in the nickel-cobalt alloy may be from about 100 ppm to about 20,000 ppm by weight. FIG. 7 of Tajiri '508 shows a schematic illustration of an exemplary multi-modal composite matrix 700 comprising phosphorous precipitates 708.

In contrast to Tajiri 508's teachings it is also well known that elemental phosphorus can be used as an alloying agent in metallic materials, most notably Ni, Co, Cu, Fe and/or Zn based alloys, i.e., by using electrodeposition conditions as practiced by the assignee of this Application, Integran Technologies Inc., as highlighted in the discussion of the Background. Popular alloys can contain between 2 and 20% per weight of phosphorus and, depending on the alloy and the phosphorus content, many of these alloys are amorphous such as galvanically deposited, e.g., electrodeposited or electroless deposited, Ni and/or Co with about 4-25% P.

Additional popular P alloys are described by Gonzalez et. al. in U.S. Pat. No. 8,663,819 (2014), cited above, prepared by DC or pulse plating containing Co with 2±1% per weight of P and unavoidable impurities totaling less than 1% with an average grain-size in the 5-25 nm range, an internal deposit tensile stress of 15±5 ksi and a as deposited Vickers hardness of 570±40 VHN as specified in MIL-DTL-32502 and AMS 2428. The Co—P deposit can be heat-treated for 24 hrs at a temperature range of between 175-200° C. to prevent hydrogen embrittlement and, optionally a further heat-treatment can be employed to increase the deposit Vickers hardness to 640±40.

Structural Metallic Layer Description:

Grain-refined electrodeposited metallic materials comprising at least one and preferably at least two elements selected from the group consisting of Co, Cu, Fe, Ni and Zn can be produced which are strong and ductile. Preferred Co, Cu, Fe, Ni and/or Zn-bearing layers/coatings comprise Co in the range of about 5 to 90 weight percent; Cu in the range of about 5 to 95 weight percent, Fe in the range of about 5 to 60 weight percent, Ni in the range of about 5 to 90 weight percent, Zn in the range of about 5 to 95 weight percent, and B, 0, P and/or S combined in the range of about 0.01 to 2.0 weight percent. In addition, embedded in the fine-grained Co, Cu, Fe, Ni and/or Zn-comprising coating can be one or more particulate representing between 0-50% per volume of the total metal matrix composite.

Adding particulates to the electrolyte which are not cathodically reduced, however, get incorporated into the metallic layer by entrapment/co-deposition forming metal matrix composites, was found to further enhance the temperature stability and can be used as a strategy to lower the content of the non-metallic additions of B, O, P and/or S. Suited particulate additions include, but are not limited to, filler additions that may include metals (Ag, Al, Cr, In, Mg, Mn, Mo, Si, Sn, Pt, Ti, V, W, Zn); metal oxides ($Ag_2O$, $Al_2O_3$, $MnO_x$, $SiO_2$, $SnO_2$, $TiO_2$, ZnO); carbides of B, Cr, Bi, Si, W; carbon (carbon, carbon fibers, carbon nanotubes, diamond, graphene, graphite, graphite fibers); glass; glass fibers; fiberglass metallized fibers such as metal coated glass fibers; mineral/ceramic fillers such as talc, calcium silicate, silica, calcium carbonate, alumina, titanium dioxide, ferrite, mica and mixed silicates (e.g. bentonite or pumice).

Minimum particulate fraction (% by volume or weight in the metal matrix composite): 0; 1; 1.5; 2.5, 5; 10.

Maximum particulate fraction (% by volume or weight in the metal matrix composite): 75; 95.

The inventors of this application have surprisingly discovered that the temperature stability, i.e., the temperature at which irreversible grain-growth in grain-refined metallic materials occurs can surprisingly be increased by the addition of at least one element, preferably at least two elements from the group consisting of boron, phosphorus, oxygen and sulfur in combined concentrations below 1% or 2% per weight. Unlike materials disclosed in both Tajiri '650 and Tajiri '508 which always comprise phosphorous, the phosphorous-free materials described in this Application can be deployed in the "as-deposited" condition and do not require the additional one or two heat-treatments specified by the noted disclosures of Tajiri to alter the microstructure to achieve the desired material properties.

The inventors note that there appears to be a symbiotic relationship between phosphorus and sulfur additions which allows the combined phosphorus and sulfur content to remain below 1% per weight, typically below 0.75% per weight (7,500 ppm) and more typically below 0.5% per weight (5,000 ppm). In the case of sulfur additions, to be effective in increasing the onset temperature for grain growth, the S content needs to be at least 100 ppm, preferably at least 250 ppm, preferably at least 300 ppm, more preferably at least 350 ppm and most preferably at least 400 ppm The maximum sulfur content may be limited to 1%, preferably to 5,000 ppm, more preferably 2,500 ppm, and most preferably to 1,000 ppm. It has surprisingly been found that the addition of sulfur in these low concentrations does not notably compromise the mechanical and chemical properties, including, but not limited to, the ductility and the corrosion behavior.

It has surprisingly been found that the addition of carbon, on the other hand, in these low concentrations does not notably improve the thermal stability. In fact, carbon additions of up 2500 ppm were found not to affect the temperature at which grain-growth commenced, while the ductility was significantly reduced. There were, however, slight differences in the rate of grain growth and metallic materials with higher carbon content tend to maintain somewhat smaller grain-sizes. As carbon provides no notable benefit to temperature stability and mechanical and chemical properties, the carbon content in the metallic material is preferably kept low, e.g. below 2,500 ppm, preferably below 1,000 ppm, more preferably below 500 ppm and even more preferably below 350 or even 100 ppm. The carbon content of the metallic materials of this specification is captured within the umbrella of "unavoidable impurities".

Articles or coatings according to the invention can be formed by incorporating suitable metallic compositions and/or metal compounds in the form of particulates, including, but not limited to, powders, fibers, and shavings, into polymeric coatings which are applied onto permanent or temporary substrates. Suitable permanent substrates include a variety of metal substrates, carbon-based materials selected from the group of graphite, graphite fibers and carbon nanotubes, and polymer substrates, commonly referred to as "plastics".

FIG. 1 depicts a conceptual cross-sectional view, in the deposition direction, of an exemplary article 100 including a temporary or permanent substrate 104 coated with a plurality of conductive layers. The temporary or permanent substrate 104 has a first surface 108 (i.e., an outer exposed surface) and a second surface 112 (i.e., an inner surface). Optionally, applied on top of first surface 108 is a thin metallizing layer 116, having an outer surface 120. Optionally, applied on top of outer surface 120 is a thin metallic conductive layer 124 having an outer surface 128. Applied on top of the outer surface 128 is the grain-refined, thermally-stable, structural layer 132 having an outer surface 136. Optionally, on top of outer surface 136 a decorative and/or functional layer 140 can be applied having an outer surface 142.

Electroplating/Electroforming Description:

The electroplating process for plating grain-refined metallic materials described herein includes the steps of: (i) providing a part including a temporary or a permanent substrate having one or more surfaces to be plated, (ii) degreasing the surface(s) of the part and, if desired, masking selected areas of the surface(s) not to be plated, (iii) activating the surface(s) to be plated, (iv) optionally applying intermediate layers and (v) suitably coating the surface(s) to be coated with one or more layers of fine-grained Co, Cu, Fe, Ni and/or Zn comprising metallic materials.

In the case of using a permanent substrate, its surface is suitably activated using a mineral acid etch, a plasma or oxidizing gas etch, and/or other surface preparation methods well known in the art. The pretreatment process steps and conditions are varied depending on the chemical composition of the substrate.

In the case of using a poorly-conductive permanent or temporary substrate made, e.g., out of a polymeric material with or without particulate addition (electrical conductivity of <1 S/m at the substrate is rendered suitably conductive for electroplating by (i) degreasing the surface(s) of the part and, if desired, masking selected areas of the surface(s) not to be plated, (ii) activating the surface(s) to be plated and depositing an electrically conductive metallizing layer in intimate contact with the polymeric material having a thickness of no more than 12.5 microns and having an electrical conductivity of $>10^4$ S/m at 20° C. such as electroless (amorphous) Ni-8-15% P, electroless (amorphous) Co-5-15% P, electroless Cu or conductive paints such as conductive carbon paints (carbon black, graphite, graphene, carbon nanotubes), metals (silver, copper, nickel) filled conductive paints and the like (iii) optionally applying one or more electrodeposited electrically conductive intermediate layer(s) in intimate contact with the metallizing layer (e.g., Cu, Ag, Ni), the conductive intermediate layer or layers in total typically having a thickness of no more than 50 microns, preferably no more than 25 microns and having an electrical conductivity of $>10^4$ S/m at 20° C. and (iv) suitably electrodepositing one or more layers of fine-grained Cu, Co, Fe, Ni and/or Zn comprising metallic materials on the surface(s) to be coated.

While all electroless Ni deposits containing between 8-15% P are amorphous, electroless copper deposition is initiated on the randomly distributed catalyst particles on the substrate and the morphology, such as the initial grain structure, is largely determined by the morphology of the substrate surface and the bath formulation and the grain structure changes as the deposit thickness increases. It is believed that, initiating at least close to the catalytic sites on the substrate where the Cu deposition occurs, fine-grained Cu films are formed.

Optionally, one or more thin layers called "intermediate conductive layers" can be applied prior to applying one or more grain-refined metallic layers of the invention. The intermediate conductive layers or structures include metallic layer comprising Co-, Ag-, Ni-, Zn-, Sn- or Cu-strikes or a combination of any two or more of these, and the intermediate conductive layer or structure can be deposited by electrodeposition, electroless deposition, sputtering, thermal spraying, chemical vapor deposition, physical vapor deposition of by any two or more of these. Intermediate conductive layers can also comprise polymeric coatings comprising additions of conductive fillers such as metals or conductive carbon materials (carbon black, graphite, carbon nanotubes and graphene), i.e., conductive paints. Conductive paints represent an elegant metallization technique as no pretreatment of the temporary substrate is required and, after plating the metallizing layer can optionally be removed by dissolution in a suitable solvent or melting/thermal decomposition by a subsequent heat-treatment.

In the case of electroforming, after removal of the temporary substrate, the grain-refined, structural metallic layers represent a minimum of 75%, preferably at least 80% and more preferably at least 95% of the total weight of the resulting article.

A person skilled in the art of plating will know how to generally electroplate selected grained-refined metallic materials, including alloys or metal matrix composites comprising at least one element selected from the group consisting of Co, Cu, Fe, Ni and Zn with minor additions of at least one, preferably at least two, non-metallic element selected from the group consisting of B, O, P, and/or S choosing suitable plating bath formulations and plating conditions as available from Integran Technologies Inc. and other vendors. In the case of tank plating, the part(s) to be plated is (are) submerged into a plating solution containing metal-ions and sources of B, O, P, and/or S containing compounds to be deposited/co-deposited, providing one or more dimensionally stable anode(s) (DSA) or one or more soluble anode(s) (SA), providing for electrical connections to the cathode(s)/workpiece(s) and anode(s) and applying direct and/or pulsed current to coat the surface of the workpiece(s) with a grained-refined metallic material coating; removing the part from the tank, washing the part, optionally baking the plated part to reduce the risk of hydrogen embrittlement and/or optionally heat treating the part to harden the grained-refined metallic materials coating, optionally polishing or buffing the surface and optionally applying other coatings, e.g., protective paints or waxes.

Dimensionally stable anodes (DSA) and/or soluble anodes (SA) can be used. Suitable DSAs include platinized metal anodes, platinum clad niobium anodes, iridium oxide coated titanium, graphite or lead anodes or the like. Soluble anodes include Co, Cu, Fe, Ni and Zn metal or their alloy rounds placed in suitable anode basket made, e.g., out of Ti, and covered by suitable anode bags. Where possible, the use of soluble anodes is preferred as, unlike when using DSAs, metal-ions lost from the electrolyte through reduction to form the coating on the cathode get replenished by metal rounds which are anodically dissolved. Further benefits of using soluble anodes include a substantial reduction in the cell voltage due to the potential difference between metal-oxidation and oxygen evolution and a much simpler bath maintenance. In some instances, due to the mismatch between anodic and cathodic current efficiencies, which result in a build-up of metal-ions in the electrolyte, the preferred choice of anodes, however, are DSAs, e.g., in the case of Zn-alloys such as Zn—Ni, Zn—Cu and Zn—Co.

In one preferred embodiment at least two metals consisting of the group of Co, Cu, Fe, Ni and Zn are electrodeposited and soluble anodes for each of the metal of choice can be employed and, using several power supplies, the anodic current to each soluble anode can be regulated independently to oxidize and dissolve the desired amount of the metal in question commensurate with the amount of said metal deposited on the workpiece to keep the ion concentration of said metal relatively constant in the electrolyte solution over the duration of the entire electroplating process.

Specifically, preferred Co, Cu, Fe, Ni and/or Zn-bearing plating solutions can include one or more dissolved Co, Cu, Fe, Ni and/or Zn-bearing compound including metal sulfates (e.g., $CoSO_4 \cdot 6H_2O$) or metal chlorides (e.g., $NiCl_2 \cdot 6H_2O$) with a preferred concentration range of $Me^{++}$ ion between 10 g/L (or mol/L) and 250 g/L (or mol/L). Other salts can be used as sources for the Co, Cu, Fe, Ni and/or Zn-bearing metal ions including, but not limited to carbonate, citrate and phosphate.

The Co, Cu, Fe, Ni and/or Zn-bearing plating solution can also contain one or more sources of B, which dissolve in the electrolyte including, but not limited to, sodium borohydride ($NaBH_4$), boric acid ($H_3BO_3$), amine-boranes such as borane dimethylamine, in a concentration in the range of between 0.1 to 50 g/L or mol/L. B-ions can get cathodically reduced to elemental B which gets co-deposited by electrochemical reduction into the metallic material forming an alloy, i.e., best described as a solid solution which is metastable at room temperature. The hardness of, e.g., Ni—B coatings can be increased by the heat-treatment between 280 and 600° C., producing crystalline phases of Ni and intermetallic $Ni_3B$.

The Co, Cu, Fe, Ni and/or Zn-bearing plating solution can also contain one or more sources of P, e.g., hypophosphorous acid ($H_3PO_2$), phosphorous acid ($H_3PO_3$) and/or orthophosphoric acid ($H_3PO_4$), and/or their salts which dissolve in the electrolyte, with a P concentration in the range of between 0.5 to 100 g/L or mol/L. Hypophosphites, which are soluble in the electrolyte, were found to be particularly suited.

Unlike in the disclosures of Tajiri '650 and Tajiri '508, where P in the cathodic deposit with an oxidation state of +III is always present in the form of phosphorous, suitable electroplating conditions are selected to ensure P in the metallic deposit of this Application is not forming a compound with O, and the O/P atomic ratio is independently variable, i.e., it is not fixed at 3:1 (3.0) as in the disclosures of Tajiri '650 and Tajiri '508, but the O/P atomic ratio can be at or below 8:3 (2.67) or at or above 10:3 (3.33). The material described herein may contain nickel phosphide ($Ni_3P$), nickel oxide ($NiO_x$ and/or $NiO_xH_y$), cobalt phosphide ($Co_2P$) and cobalt oxide ($CoO_x$ and/or $CoO_xH_y$), with x and y typically being between 0 and 1.

Unlike the materials of Tajiri '650 and Tajiri '508, the metallic deposits prepared in accordance with this Application do not require a heat-treatment at a temperature below the onset of grain growth and at times a second heat-treatment at a temperature above the onset of grain growth to achieve the desired composition, microstructure and properties, but can be readily deployed in the "as deposited condition". This feature is of particular importance when using polymeric permanent substrates which, when heat-treated at temperature in accordance with the prior art teachings, would deteriorate, decompose or melt.

Without being bound to any theory, it is submitted that in the materials of this invention between 300 and 375° C., in the case of electrodeposited Ni-ultra-low-P alloys, a crystalline mixture of nickel and $Ni_3P$, an intermetallic solid solution of Ni and P, with both elements having an oxidation state of zero (0), is formed which can lead to a slight increase in hardness of the heat-treated, when compared to the as-deposited material.

As the Co, Cu, Fe, Ni and/or Zn-bearing bearing plating solution are aqueous solutions they contain O bound in water. When employing reverse pulse plating, i.e., adding anodic pulses to the cathodic pulses which deposit the metallic material by reduction, during the anodic pulse oxidation occurs at the metallic layer surface which results in oxidation and dissolution of the metallic component, however, it also results in some metal oxide ($MeO_x$) formation which can be at least partially preserved by the rapidly following cathodic pulse in which new metal deposition from the electrolyte solution competes with the reduction of the surface oxide. The longer (e. g., measured in milliseconds) and steeper (e.g., measured in $mA/cm^2$) the anodic pulse the more O is retained in the metallic material typically at or near the grain-boundaries. Using reverse pulsing over 1% of O can readily be incorporated into the metallic material. While an oxygen content as low as 100 ppm, in the case of e.g., Ni—Co alloys, can have a beneficial effect on temperature stability, in the temperature range of interest (300-450° C.) it was found that, when not combined with other non-metallic alloying agents, between 0.5 and ≤1.0% of oxygen is typically required in the metallic material to limit the hardness loss after heat-treatment of 12 hours at 350° C. to less than 10%. It is worth noting that, unlike the prior art materials (i.e., the teachings of Tajiri '650 and Tajiri '508) which exclusively incorporate O in the deposit from $PO_3^{3-}$ containing compounds added to the electrolyte, the source of O in this Application predominately is the water of the aqueous electrolyte solution.

Unlike in Tajiri '650 and Tajiri '508, where O in the cathodic deposit is present as $[PO_3]^3$, a phosphorous precipitate and a compound of O with P which, according to the teachings of Tajiri, precipitates at the grain-boundaries, O in the metallic deposit of this Application is generally not forming a compound with P, instead it bonds with a metallic element and forms an oxide with any of the metallic elements, i.e., $MeO_x$ and/or $MeO_xH_y$, wherein Me is a metallic element selected from the group consisting of Co, Cu, Fe, Ni and Zn. According to the present application, there are no phosphorous precipitates at nanocrystalline grain-boundaries of the electrodeposited metallic alloy.

The Co, Cu, Fe, Ni and/or Zn-bearing bearing plating solution also contains one or more sources of S, e.g., organic S-bearing compounds which dissolve in the electrolyte and can get cathodically reduced to elemental S, including, but not limited to, saccharin (3-oxo-2,3-dihydrobenzo[d]isothiazol-1,1-dioxide), available as, e.g., acid saccharin, sodium saccharin, potassium saccharin and calcium saccharin, in a concentration in the range of between 0.1 to or mol/L. Other examples of a S-donor are cysteine, thiourea, benzene sulfonic acid, 1, 3, 6-naphtaline sulfonic acid (or its Na, K, or Li salt), p-toluenesulfonic acid, sulphonamide, allyl sulfonic acid and coumarins, including, but not limited to, sodium or potassium 7-oxyomegasulfopropyl coumarin, sodium or potassium 7-oxyomegasulfopropyl coumarin and the like. Specially, S-containing organic compounds are purposely added to the electrolyte in this Application as source for the S desired to be incorporated into the metallic material and S does not originate from "unavoidable impurities".

According to Tajiri '508, in paragraph the concentration of the sulfur in the nickel-cobalt alloy is less than about 250 ppm by weight, and according to paragraph of Tajiri '508, S may originate from impurities present in the organic grain refining additive.

It has also been reported that sulfur can be co-deposited in metallic materials using electrodeposition, however, in general additions of sulfur are undesired as they cause brittleness and compromise the corrosion behavior. For instance, sulfur, in the form of iron sulfide (FeS), can cause steel to become porous and prone to cracking. Sulfur embrittlement of nickel by grain boundary adsorption of S can cause catastrophic brittle failures of the otherwise ductile Ni, and other metallic alloys, at low stress levels. In addition, sulfur exposure from the environment (air or water) is known to be detrimental to corrosion behavior of metallic materials. Elemental sulfur, $H_2S$, and $SO_2$ have been reported to significantly increase the corrosion of carbon steels under both aerated and de-aerated conditions in the presence of water. Elemental sulfur deposition on metallic materials used in oil and gas pipelines and facilities has become a major concern due to the increased production of sour oil and natural gas. Consequently, presence of sulfur in metallic materials or in the environment metallic materials are exposed to has heretofore been usually considered undesirable.

The inventors of the present Application have surprisingly noted that in the case of grain-refined metallic materials, however, very small additions of S can be beneficial in maintaining the strength/hardness at increased temperatures without unduly compromising other material properties.

Preferably, the B, P, O and/or S-containing, electrolyte soluble, donor compounds selected to be added to the electrolyte solution also provide other beneficial properties to the electroplating solution including, but not limited to, brighteners, grain-refiners, surfactants and levelers.

The Co, Cu, Fe, Ni and/or Zn-bearing bearing plating solution also typically contains one or more additives selected from the group of surfactants, brighteners, grain-refiners, stress-relievers, salts to raise the ionic conductivity and pH adjusters. Stress-controlling agents and grain-refiners based on sulfur compounds such as sodium saccharin, coumarin and thiourea may be added in the range of 0 to 10 g/L to control the grain-size/hardness and the stress while providing a convenient source of S. Other suitable grain refiners/brighteners include borates and/or perborates in the concentration range of between 0 and 10 g/L of B while providing a convenient source of B. Sodium, potassium or other chlorides can be added to increase the ionic conductivity of the plating solution which may also act as stress relievers.

A preferred range for the pH value of the plating solution is between 0.5 and 5. Alternatively, the plating solution can be alkaline (up to pH 14) containing an excess of complexing agents for the metal ions such as cyanide, ethylenediamine tetraacetic acid (EDTA) or pyrophosphate to prevent precipitation of metal hydroxides. The surface tension of the Co, Cu, Fe, Ni and/or Zn-bearing bearing plating solution may be in a preferred range of 30 to 100 dyne/cm. A preferred temperature range of the Co, Cu, Fe, Ni and/or Zn-bearing bearing plating solution is 20 to 120° C.

When using soluble anodes Co-ion, Cu-ion, Fe-ion, Ni-ion and/or Zn-ion depletion in the electrolyte solution is prevented by using Co, Cu, Fe, Ni and/or Zn electrolytic rounds, and/or alloy rounds, as soluble anodes, e.g., retained in Ti anode baskets otherwise metal-ions depletion in the electrolyte solution is prevented by suitable bath additions.

After suitably contacting one or more anodes and one or more parts serving as cathode(s), direct or pulsed current (including the use of one or more cathodic pulses, and optionally anodic pulses and/or off times) is applied between the cathode(s) and the anode(s). A suitable duty cycle is in the range of 25% to 100%, preferably between 50 and 100% and suitable applied average cathodic current densities are in the range of 20 to 300 $mA/cm^2$, preferably between about 50 and 200 $mA/cm^2$. This results in deposition rates of between 0.025 and 0.5 mm/h. Agitation rates can also be used to affect the microstructure and the deposit stress and suitable agitation rates range from about 0.01 to 10 liter per minute and effective cathode or anode area to from about 0.1 to 300 liter per minute and applied Ampere.

By using the electrodeposition process described, Co, Cu, Fe, Ni and/or Zn-comprising coatings can be produced which are ductile, free of cracks, and possess sufficient hardness and residual stress to meet wear and fatigue requirements for wear-resistant coatings. Preferred Co, Cu, Fe, Ni and/or Zn-bearing coatings may comprise Co in the range of about 5 to 95 weight percent; Cu in the range of about 5 to 95 weight percent, Fe in the range of about 5 to 75 weight percent, Ni in the range of about 5 to 95 weight percent, Zn in the range of 35 to 95 weight percent, and B, O, P and/or S combined in the range of about 0.01 to 1.0 weight percent. In addition, embedded in the fine-grained Co, Cu, Fe and/or Ni-comprising coating can be one or more particulates representing between 0-50% per volume of the total metal matrix composite.

Using the process described a preferred Co, Cu, Fe, Ni and/or Zn-comprising coating with up to 1.0%, 1.5% or even 2% of combined B, O, P and/or S, can be electrodeposited. The as-deposited hardness depends on the chemical composition and the average grain-size; however, it typically is in the range of 25 to 900 VHN. To prevent hydrogen embrittlement the deposit can be heat-treated for at least 12 hours, preferably 24 hours at a temperature range of between 175-200° C. Such a heat-treatment can also be employed to melt/decompose a temporary substrate and/or metallizing paint layer to yield an entirely structural, grain-refined article and furthermore, e.g., in the case of Ni—Co alloys, can be conveniently used as the Heat-Treatment Test to determine the change in hardness. Optionally, a further heat-treatment can be employed to increase the deposit Vickers hardness of P and/or B containing grain-refined metallic materials by between 50 and 250 VHN. Most notably, the Co, Cu, Fe, Ni and/or Zn-comprising coatings containing minor additions of B, O, P and/or S according to this specification are particularly suited for use in high-temperature applications, characterized by the hardness of said electrodeposited metallic alloy layer after heat-treatment for 12 hours in an inert atmosphere at a temperature of 350° C. when the total combined Co, Fe and Ni content of the metallic material is at least 50% per weight, 200° C. when the total Cu content of the metallic material is at least 50% per weight, and 100° C. when the total Zn content of the metallic material is at least 50% per weight, that retains at least 90% of the as-deposited hardness, preferably at least 95% of the as-deposited hardness and most preferably 100% of the as-deposited hardness.

As highlighted above, the inventors of the present Application discovered that only small additions of non-metallic additives are required to stabilize the nanocrystalline grain-size of the noted metallic materials. The total amount of non-metallic additives depends on a number of factors. For instance, it was observed that the grain-size of binary or ternary alloys containing at least 5% of another metal can be more readily stabilized than a single, relatively pure, metal. In addition, it was noted that the smaller the as-deposited grain-size is, the higher the concentrations of non-metallic additions are required to stabilize the grain structure. Average grain-sizes below typically require more non-metallic additions to stabilize compared to the same composition having average grain-sizes in the 50-100 nm range and composition having average grain-sizes greater than 100 nm require the smallest additions. Furthermore, relying on two or more non-metallic additions to stabilize the grain-size also minimizes the total amount of non-metallic additives required to meet the temperature stability requirement, thereby minimizing undesired changes in the material property such as reduced ductility and/or reduced corrosion resistance.

The preference for binary or ternary or even quaternary alloys containing at least 5% of each metal can be conveniently accomplished using electrodeposition from a single electrolyte solution by simply varying the electrical parameters, as desired. Embodiments where the electroplated compositions are comprised of a plurality of thin layers of alternating hard and soft materials laminated together, the electrodeposited composition may display Koehler toughening. That form of toughening results from a deflection of a nascent crack at the layer interface due to differing elastic moduli. Nano-laminates can absorb the energy that typically causes cracking and prevent or substantially delay bulk material failure. In addition, nano-laminates can provide for enhanced strength, ductility and fracture toughness and wear.

An exemplary metallic material may be a nickel-cobalt alloy which may include from 40% to 90% by weight nickel, from 10% to 60% by weight cobalt, from 100 ppm to 20,000 ppm by weight combined of phosphorus, boron, oxygen and sulfur, and less than 1% by weight of all impurities which include less than 75 ppm phosphorous.

The concentration of nickel in the nickel-cobalt alloy may be from 40% to 90% by weight, such as from 50% to 80% by weight, such as from 60% to 70% by weight. The concentration of nickel in the nickel-cobalt alloy may be at least 20% by weight, such as at least 40% by weight, such as at least 60% by weight, such as at least 70% by weight, or such as at least 80% by weight. The concentration of nickel in the nickel-cobalt alloy may be less than 90% by weight, such as less than 80% by weight, such as less than 75% by weight, such as less than 70% by weight, such as less than 60% by weight, or such as less than 50% by weight.

The concentration of cobalt in the nickel-cobalt alloy may be from 10% to 60% by weight, such as from 20% to 50% by weight, such as from 25% to 45% by weight. The concentration of cobalt in the nickel-cobalt alloy may be at least 10% by weight, such as at least 20% by weight, such as at least 25% by weight, such as at least 30% by weight, such as at least 40% by weight, or such as at least 50% by weight. The concentration of cobalt in the nickel-cobalt alloy may be less than 60% by weight, such as less than 50% by weight, or such as less than 40% by weight.

In one embodiment the metallic material comprises Ni and/or Co in a range independently selected from 5% to 10%, 7.5% to 15%, 10% to 20%, 12.5% to 25%, from 20% to 40%, from 35% to 70%, from 60% to 95%, from 90% to 99%, P and/or B in a range independently selected from 500 ppm to 1,000 ppm, 750 ppm to 3,000 ppm, 1,000 ppm to 1,500 ppm to 10,000 ppm, O in a range independently selected from 100 ppm to 500 ppm, 300 ppm to 750 ppm, 500 ppm to 1,000 ppm, 750 ppm to 3,000 ppm, S in a range independently selected from 100 ppm to 500 ppm, 300 ppm to 750 ppm, 500 ppm to 1,000 ppm, 750 ppm to 3,000 ppm, up to 1% unavoidable impurities including less than 75 ppm phosphorous and the balance, if any, being at least one metallic element selected from the group consisting of Cu, Zn and Fe.

An exemplary metallic material may be a nickel-iron alloy or a cobalt-iron alloy or nickel-cobalt-iron alloy which may include from 10% to 90% by weight nickel and/or cobalt, from 10% to 90% by weight iron, from 100 ppm to 20,000 ppm by weight combined of phosphorus, boron, oxygen and sulfur, and less than 1% by weight of all impurities.

The concentration of nickel and/or cobalt in the nickel-iron alloy, cobalt-iron alloy or nickel-cobalt-iron alloy may be from 10% to 90% by weight, such as from 20% to 80% by weight, or such as from 40% to 60%. The concentration of nickel and/or cobalt in the nickel-iron alloy, cobalt-iron alloy or nickel-cobalt-iron alloy may be at least 10% by weight, such as at least 25% by weight, such as at least 50% by weight, such as at least 75% by weight, or such as at least 80% by weight. The concentration of nickel and/or cobalt in the nickel-iron alloy, cobalt-iron alloy or nickel-cobalt-iron alloy may be less than 90% by weight, such as less than 80% by weight, such as less than 75% by weight, such as less than 70% by weight, such as less than 60% by weight, or such as less than 50% by weight.

The concentration of iron in the nickel-iron alloy, cobalt-iron alloy or nickel-cobalt-iron alloy may be from 5% to 75% by weight, such as from 10% to 30% by weight, or such as from 30% to 60% by weight. The concentration of iron in the nickel-iron alloy, cobalt-iron alloy or nickel-cobalt-iron alloy may be at least 5% by weight, such as at least 10% by weight, such as at least 25% by weight, such as at least 30% by weight, such as at least 40% by weight, or such as at least 50% by weight. The concentration of iron in the nickel-iron alloy, cobalt-iron alloy or nickel-cobalt-iron alloy may be less than 70% by weight, such as less than 60% by weight, or such as less than 50% by weight.

The concentration of iron in the metallic material may be independently selected from 5% to 10%, 7.5% to 15%, 10% to 20%, 12.5% to 25%, from 20% to 40%, from 35% to 70%, P and/or B in a range independently selected from 500 ppm to 1,000 ppm, 750 ppm to 3,000 ppm, 1,000 ppm to 5,000 ppm, 1,500 ppm to 10,000 ppm, O in a range independently selected from 100 ppm to 500 ppm, 300 ppm to 750 ppm, 500 ppm to 1,000 ppm, 750 ppm to 3,000 ppm, S in a range independently selected from 100 ppm to 500 ppm, 300 ppm to 750 ppm, 500 ppm to 1,000 ppm, 750 ppm to 3,000 ppm, up to 1% unavoidable impurities and the balance being at least one metallic element selected from the group consisting of Ni, Co, Cu, and Zn.

An exemplary metallic material may be a nickel-copper alloy or a cobalt-copper alloy or nickel-cobalt-copper alloy which may include from 10% to 90% by weight nickel and/or cobalt, from 10% to 90% by weight copper, from 100 ppm to 20,000 ppm by weight combined of phosphorus, boron, oxygen and sulfur, and less than 1% by weight of all impurities.

The concentration of nickel and/or cobalt in the nickel-copper alloy or cobalt-copper alloy or nickel-cobalt-copper alloy may be from 5% to 95% by weight, such as from 10% to 80% by weight, or such as from 20% to 60%. The concentration of nickel and/or cobalt in the nickel-copper alloy or cobalt-copper alloy or nickel-cobalt-copper alloy may be at least 5% by weight, such as at least 10% by weight, such as at least 15% by weight, such as at least 25% by weight, or such as at least 50% by weight. The concentration of nickel and/or cobalt in the nickel-copper alloy or the cobalt-copper alloy or the nickel-cobalt-copper alloy may be less than 95% by weight, such as less than 75% by weight, such as less than 50% by weight, such as less than 25% by weight, such as less than 15% by weight, or such as less than 10% by weight.

The concentration of copper in the nickel-copper alloy or cobalt-copper alloy or nickel-cobalt-copper alloy may be from 5% to 95% by weight, such as from 10% to 90% by weight, or such as from 30% to 60% by weight, The concentration of copper in the nickel-copper alloy or the cobalt-copper alloy or the nickel-cobalt-copper alloy may be at least 5% by weight, such as at least 25% by weight, such as at least 50% by weight, such as at least 75% by weight, such as at least 80% by weight, or such as at least 90% by weight. The concentration of copper in the nickel-copper alloy or the cobalt-copper alloy or the nickel-cobalt-copper alloy may be less than 95% by weight, such as less than 90% by weight, or such as less than 75% by weight.

An exemplary metallic material may be a nickel-zinc alloy or a cobalt-zinc or nickel-cobalt-zinc alloy which may include from 5% to 90% by weight nickel and/or cobalt, from 10% to 95% by weight zinc, from 100 ppm to 20,000 ppm by weight combined of phosphorus, boron, oxygen and sulfur, and less than 1% by weight of all impurities.

The concentration of nickel and/or cobalt in the nickel-zinc, cobalt-zinc or nickel-cobalt-zinc alloy may be from 5% to 90% by weight, such as from 10% to 75% by weight, or such as from 5% to 25%. The concentration of nickel and/or cobalt in the nickel-zinc, cobalt-zinc or nickel-cobalt-zinc alloy may be at least 5% by weight, such as at least 7.5% by weight, such as at least 10% by weight, such as at least 15% by weight, or such as at least 20% by weight. The concentration of nickel and/or cobalt in the nickel-zinc, cobalt-zinc or nickel-cobalt-zinc alloy may be less than 90% by weight, such as less than 75% by weight, such as less than 25% by weight, such as less than 20% by weight, such as less than 15% by weight, or such as less than 10% by weight.

The concentration of zinc in the nickel-zinc, cobalt-zinc or nickel-cobalt-zinc alloy may be from 5% to 95% by weight, such as from 10% to 90% by weight, or such as from 25% to 75% by weight. The concentration of zinc in the nickel-zinc, cobalt-zinc or nickel-cobalt-zinc alloy may be at least 5% by weight, such as at least 25% by weight, such as at least 50% by weight, such as at least 75% by weight, such as at least 80% by weight, or such as at least 90% by weight. The concentration of zinc in the nickel-zinc, cobalt-zinc or nickel-cobalt-zinc alloy may be less than 95% by weight, such as less than 90% by weight, or such as less than 80% by weight.

An exemplary metallic material may be an iron-zinc alloy which may include from 5% to 35% by weight iron, from about 65% to about 95% by weight zinc, from about 100 ppm to 20,000 ppm by weight combined of phosphorus, oxygen and sulfur, and less than 1% by weight of all impurities.

The concentration of iron in the iron-zinc alloy may be from 5% to 35% by weight, such as from 5% to 25% by weight, such as from 7.5% to 20% by weight, or such as from about 10% to about 27.5% by weight. The concentration of iron in the iron-zinc alloy may be at least 1% by weight, such as at least 5% by weight, such as at least 10% by weight, such as at least 15% by weight, or such as at least 20% by weight. The concentration of iron in the iron-zinc alloy may be less than 35% by weight, such as less than 25% by weight, such as less than 20% by weight, such as less than 17.5% by weight, such as less than 15% by weight, or such as less than 10% by weight.

The concentration of zinc in the iron-zinc alloy may be from 60% to 95% by weight, such as from 70% to 95% by weight, or such as from 80% to 95% by weight. The concentration of zinc in the iron-zinc alloy may be at least 60% by weight, such as at least 70% by weight, such as at least 80% by weight, or such as at least 90% by weight. The concentration of zinc in the iron-zinc alloy may be less than 95% by weight, such as less than 90% by weight, or such as less than 80% by weight.

Another exemplary metallic material may be a copper-zinc alloy which may include from 40% to 90% by weight copper, from 10% to 60% by weight zinc, from 100 ppm to 20,000 ppm by weight combined of phosphorus, boron, oxygen and sulfur, and less than 1% by weight of all impurities.

The concentration of copper in the copper-zinc alloy may be from 40% to 90% by weight, such as from 50% to 80% by weight, such as from 60% to 70% by weight. The concentration of copper in the copper-zinc alloy may be at least 40% by weight, such as at least 50% by weight, such as at least 60% by weight, such as at least 70% by weight, or such as at least 80% by weight. The concentration of copper in the copper-zinc alloy may be less than 90% by weight, such as less than 80% by weight, such as less than 75% by weight, such as less than 70% by weight, such as less than 60% by weight, or such as less than 50% by weight.

The concentration of zinc in the copper-zinc alloy may be from 10% to 60% by weight, such as from 20% to 50% by weight, such as from 25% to 45% by weight. The concentration of zinc in the copper-zinc alloy may be at least 10% by weight, such as at least 20% by weight, such as at least 25% by weight, such as at least 30% by weight, such as at least 40% by weight, or such as at least 50% by weight. The concentration of zinc in the copper-zinc alloy may be less than 60% by weight, such as less than 50% by weight, or such as less than 40% by weight.

The concentration of phosphorus (P) and/or boron (B) in the metallic material may be in a range independently selected from 100 ppm to 20,000 ppm by weight, such as from 100 ppm to such as from 100 ppm to 10,000 ppm, such as from 500 ppm to 5,000 ppm, such as from 1,000 ppm to 3,500 ppm. The concentration of phosphorus (P) and/or boron (B) in the metallic material may be at least 100 ppm by weight, such as at least 300 ppm, such as at least 400 ppm, such as at least 500 ppm, such as at least 750 ppm, such as at least 1,000 ppm, such as at least 1,500 ppm, such as at least 2,000 ppm, such as at least 5,000 ppm, such as at least 7,500 ppm, such as at least 10,000 ppm, or such as at least 15,000 ppm by weight. The concentration of phosphorus (P) and/or boron (B) in the metallic material may be less than 20,000 ppm by weight, such as less than 15,000 ppm, such as less than 10,000 ppm, such as less than 7,500 ppm, such as less than 5,000 ppm, such as less than 2,500 ppm, or such as less than 1,000 ppm. The balance being at least one metallic element selected from the group consisting of Ni, Co, Cu, Fe, and Zn.

The concentration of the sulfur (S) and/or oxygen (O) in metallic material may be in a range independently selected from 100 ppm to 10,000 ppm by weight, such as from 100 ppm to 5,000 ppm, such as from 100 ppm to 1,000 ppm, such as from 300 ppm to 10,000 ppm, such as from 300 ppm to 5,000 ppm, such as from 300 ppm to about 2,500 ppm. The concentration of sulfur (S) and/or oxygen (O) in the metallic material may be at least 100 ppm by weight, such as at least 250 ppm, such as at least 300 ppm, such as at least 350 ppm, such as at least 400 ppm, such as at least 500 ppm, such as at least 7500 ppm, such as at least 1,000 ppm, such as at least 1,500 ppm, such as at least 2,000 ppm, such as at least 5,000 ppm, such as at least 7,500 ppm, such as at least 10,000 ppm, or such as at least 15,000 ppm by weight. The concentration of sulfur (S) and/or oxygen (O) in the metallic material may be less than 15,000 ppm by weight, such as less than such as less than 7,500 ppm, such as less than 5,000 ppm, such as less than 2,500 ppm, such as less than 2,000 ppm, such as less than about 1,500 ppm, such as less than about 1,000 ppm, such as less than about 750 ppm, or such as less than 500 ppm. The metallic material may also contain P and/or B in the concentrations listed above, the balance being at least one metallic element selected from the group consisting of Ni, Co, Cu, Fe, and Zn.

While alloys comprising two or more elements selected from the group consisting of Co, Cu, Ni, Fe and Zn are generally preferred due to the enhanced thermal stability of alloys, as noted above, metallic materials according to the current Application may also comprise a single metal. In this case, e.g., when using up to 99.9% unalloyed Co, Cu, Ni, Fe and Zn the amount of non-metallic elements selected from the group consisting of B, O, P and S may be somewhat higher than the amount required to stabilize a binary, ternary or quaternary alloy comprising these elements. As highlighted above, addition of particulates can also be used to form metal matrix composites and further enhance the temperature stability.

In one embodiment the metallic material comprises an average grain-size in a range independently selected from 10 nm to 1,000 nm, 25 nm to 1,000 nm, 50 nm to 1,000 nm, 50 nm to 750 nm, 75 nm to 500 nm or 1000 nm to 750 nm.

Further aspects of the invention are provided by the subject matter of the following clauses:

1. An electrodeposited metallic material comprising:
(i) a microcrystalline grain structure with an average grain-size in the range of 2 to 1,000 nm;
(ii) at least one metallic element selected from the group consisting of Co, Cu, Fe, Ni and Zn;
(iii) at least one non-metallic element selected from the group consisting of B, O, P and S;
(iv) said non-metallic element(s) in total comprising between 50 ppm and 20,000 ppm per weight of the electrodeposited metallic material; and
(v) said electrodeposited metallic material, after heat-treatment for 12 hours at a temperature of 100° C. in an inert atmosphere, retains at least 90% of the as-deposited hardness.

2. The electrodeposited metallic material of the preceding clause, wherein there are no phosphorous precipitates at nanocrystalline grain-boundaries of the electrodeposited metallic material.

3. The electrodeposited metallic material of any preceding nonconflicting clause which comprises Ni and P.

4. The electrodeposited metallic material of any preceding nonconflicting clause which comprises Ni containing at least one non-metallic element selected from the group consisting of B and P and at least one non-metallic element selected from the group consisting of O and S.

5. The electrodeposited metallic material of any preceding nonconflicting clause which comprises Co and P.

6. The electrodeposited metallic material of any preceding nonconflicting clause which comprises Co containing at least one non-metallic element selected from the group consisting of B and P and at least one non-metallic element selected from the group consisting of O and S.

7 The electrodeposited metallic material of any preceding clause which comprises Cu and P.

8. The electrodeposited metallic material of the preceding nonconflicting clause which comprises Cu containing at least one non-metallic element selected from the group consisting of B and P and at least one non-metallic element selected from the group consisting of O and S.

9. An electrodeposited metallic material comprising:
(i) a microcrystalline grain structure with an average grain-size in the range of 2 to 1,000 nm;
(ii) at least two metallic elements selected from the group consisting of Co, Cu, Fe, Ni and Zn;
(iii) each of said metallic elements present comprising at least 5% per weight of the electrodeposited metallic material;
(iv) at least one non-metallic element selected from the group consisting of B, O, P and S; and
(v) said non-metallic element(s) in total comprising between 50 ppm and 20,000 ppm per weight of the electrodeposited metallic material; and
(vi) said electrodeposited metallic material, after heat-treatment for 12 hours at a temperature of 100° C. in an inert atmosphere, retains at least 90% of the as-deposited hardness of said electrodeposited metallic material.

10. An electrodeposited metallic material comprising:
(i) a microcrystalline grain structure with an average grain-size in the range of 2 to 1,000 nm;
(ii) at least three metallic elements selected from the group consisting of Co, Cu, Fe, Ni and Zn;
(iii) each of said metallic elements comprising at least 5% per weight of the electrodeposited metallic material;
(iv) at least one non-metallic element selected from the group consisting of B, O, P and S; and
(v) said non-metallic element(s) in total comprising between 50 ppm and 20,000 ppm per weight of the electrodeposited metallic material; and
(vi) said electrodeposited metallic material, after heat-treatment for 12 hours at a temperature of 100° C. in an inert atmosphere, retains at least 90% of the as-deposited hardness of said electrodeposited metallic material.

11. The electrodeposited metallic material of any preceding nonconflicting clause, wherein the electrodeposited metallic material comprises at least two non-metallic elements selected from the group consisting of B, O, P and S.

12. The electrodeposited metallic material of any preceding nonconflicting clause, wherein the electrodeposited metallic material comprises at least three non-metallic elements selected from the group consisting of B, O, P and S.

13. The electrodeposited metallic material of any preceding nonconflicting clause, wherein the electrodeposited metallic material is a Ni—Co alloy comprising between 30% and 95% by weight Ni, between 10% and 60% by weight Co, and electrodeposited metallic material contains between 100 ppm and 20,000 ppm combined of at least one non-metallic element selected from the group consisting of B, O, P and S and the electrodeposited metallic material contains less than 1% by weight of unavoidable impurities which include less than 75 ppm phosphorous, and said electrodeposited metallic material, after heat-treatment for 12 hours at a temperature of 200° C. in an inert atmosphere, retains at least 90% of the as-deposited hardness of said electrodeposited metallic material.

14. The electrodeposited metallic material of any preceding nonconflicting clause, wherein the electrodeposited metallic material is a Ni—Co alloy comprising between 30% and 95% by weight Ni, between 5% and 70% by weight Co, and between 100 ppm and 20,000 ppm combined of non-metallic elements comprising at least one non-metallic element selected from the group consisting of B and P and at least one non-metallic element selected from the group consisting of O and S and the electrodeposited metallic material contains less than 1% by weight of unavoidable impurities which include less than 75 ppm phosphorous.

15. The electrodeposited metallic material of any preceding nonconflicting clause, wherein the electrodeposited metallic material is a Ni—Co alloy comprising between 30% and 95% by weight Ni, between 5% and 70% by weight Co, and between 100 ppm and 20,000 ppm combined of non-metallic elements comprising at least one element selected from the group consisting of O and S and at least one non-metallic element selected from the group consisting of B and P. 16. The electrodeposited metallic material of any preceding nonconflicting clause, wherein the concentration of Co in the Ni—Co alloy is at least 25% by weight.

17. The electrodeposited metallic material of any preceding nonconflicting clause, wherein the concentration of Ni in the Ni—Co alloy is equal to or less than 75% by weight.

18. The electrodeposited metallic material of any preceding clause, wherein the electrodeposited metallic alloy is free of phosphorous and phosphite.

19. The electrodeposited metallic material of any preceding nonconflicting clause, wherein the electrodeposited metallic material contains at least 50% combined of one or more elements selected from the group consisting of Ni, Co and Fe and the hardness of said electrodeposited metallic material after heat-treatment for 12 hours at a temperature of 350° C. in an inert atmosphere retains at least 90% of the as-deposited hardness.

20. The electrodeposited metallic material of any preceding nonconflicting clause, wherein the electrodeposited metallic material is a Ni—Fe alloy comprising between 75% and 95% by weight of Ni, between 5% and 25% by weight of Fe, and between 100 ppm and 20,000 ppm combined of at least one non-metallic element selected from the group consisting of B, O, P and S.

21. The electrodeposited metallic material of any preceding nonconflicting clause, wherein the electrodeposited metallic material is a Ni—Fe alloy comprising between 30% and 70% by weight of Ni, between 30% and 70% by weight of Fe, and between 100 ppm and 20,000 ppm combined containing at least one non-metallic element selected from the group consisting of B and P and at least one non-metallic element selected from the group consisting of O and S.

22. The electrodeposited metallic material of any preceding nonconflicting clause, wherein the electrodeposited metallic material is a Ni—Fe alloy comprising between 5% and 95% by weight Ni, between 5% and 95% by weight Fe, and between 100 ppm and 20,000 ppm combined containing at least one non-metallic element selected from the group consisting of B and P and at least one non-metallic element selected from the group consisting of O and S.

23. The electrodeposited metallic material of any preceding nonconflicting clause, wherein the concentration of Ni in the Ni—Fe alloy is at least 5% by weight.

24. The electrodeposited metallic material of any preceding nonconflicting clause, wherein the concentration of Ni in the Ni—Fe alloy is equal to or less than 75% by weight.

25. The electrodeposited metallic material of any preceding nonconflicting clause, wherein the hardness of the electrodeposited metallic material after heat-treatment for 12 hours at a temperature of 200° C. in an inert atmosphere retains at least 90% of the as-deposited hardness.

26. The electrodeposited metallic material of any preceding nonconflicting clause, wherein the electrodeposited metallic material is a Co—Fe alloy comprising between 75% and 95% by weight Co and between 5% and 25% by weight Fe, and between 100 ppm and 20,000 ppm combined of at least one non-metallic element selected from the group consisting of B, O, P and S.

27. The electrodeposited metallic material of any preceding nonconflicting clause, wherein the electrodeposited metallic material is a Co—Fe alloy comprising between 30% and 70% by weight Co, between 30% and 70% by weight Fe, and between 100 ppm and 20,000 ppm combined of non-metallic elements comprising at least one non-metallic element selected from the group consisting of B and P and at least one non-metallic element selected from the group consisting of O and S.

28. The electrodeposited metallic material of any preceding nonconflicting clause, wherein the electrodeposited metallic material is a Co—Fe alloy comprising between 5% and 95% by weight Co, between 5% and 95% by weight Fe, and between 100 ppm and 20,000 ppm combined of non-metallic elements comprising at least one non-metallic element selected from the group consisting of B and P and at least one non-metallic element selected from the group consisting of O and S.

29. The electrodeposited metallic material of any preceding nonconflicting clause, wherein the concentration of Co in the Co—Fe alloy is at least 5% by weight.

30. The electrodeposited metallic material of any preceding nonconflicting clause, wherein the concentration of Co in the Co—Fe alloy is equal to or less than 75% by weight.

31. The electrodeposited metallic material of any preceding nonconflicting clause, wherein the hardness of the electrodeposited metallic material after heat-treatment for 12 hours at a temperature of 200° C. in an inert atmosphere retains at least 90% of the as-deposited hardness.

32. The electrodeposited metallic material of any preceding nonconflicting clause, wherein the electrodeposited metallic material is a Ni—Co—Fe alloy comprising between 75% and 95% by weight of Ni and/or Co, between 5% and 25% by weight Fe, and between 100 ppm and combined of at least one non-metallic element selected from the group consisting of B, O, P and S.

33. The electrodeposited metallic material of any preceding nonconflicting clause, wherein the electrodeposited metallic material is a Ni—Co—Fe alloy comprising between 30% to 70% by weight Ni and/or Co, between 30% and 70% by weight Fe, and between 100 ppm and 20,000 ppm combined of at least two non-metallic elements selected from the group consisting of B, O, P and S.

34. The electrodeposited metallic material of any preceding nonconflicting clause, wherein the electrodeposited metallic material is a Ni—Co—Fe alloy comprising between 5% and 95% by weight Ni and/or Co, between 5% and 95% by weight Fe, and between 100 ppm and 20,000 ppm combined of non-metallic elements containing at least one non-metallic element selected from the group consisting of B and P and at least one non-metallic element selected from the group consisting of O and S.

35. The electrodeposited metallic material of any preceding nonconflicting clause, wherein the concentration of Ni and/or Co in the Ni—Co—Fe alloy is at least 5% by weight.

36. The electrodeposited metallic material of any preceding nonconflicting clause, wherein the concentration of Ni and/or Co in the Ni—Co—Fe alloy is equal to or less than 75% by weight.

37. The electrodeposited metallic material of any preceding nonconflicting clause, wherein the hardness of said electrodeposited metallic material after heat-treatment for 12 hours at a temperature of 350° C. in an inert atmosphere retains at least 90% of the as-deposited hardness.

38. The electrodeposited metallic material of any preceding nonconflicting clause, wherein the electrodeposited metallic material is a Ni—Zn alloy comprising between 5% and 25% by weight Ni, between 75% and 95% by weight Zn, and between 100 ppm and 20,000 ppm combined of at least one non-metallic element selected from the group consisting of B, O, P and S.

39. The electrodeposited metallic material of any preceding nonconflicting clause, wherein the electrodeposited metallic material is a Ni—Zn alloy comprising between 5% and 25% by weight Ni, between 75% and 95% by weight Zn, and between 100 ppm and 20,000 ppm combined of non-metallic elements containing at least one non-metallic element selected from the group consisting of B and P and at least one non-metallic element selected from the group consisting of O and S.

40. The electrodeposited metallic material of any preceding nonconflicting clause, wherein the electrodeposited metallic material is a Co—Zn alloy comprising between 5% and 25% by weight Co, between 75% and 95% by weight Zn, and between 100 ppm and 20,000 ppm combined of at least one non-metallic element selected from the group consisting of B, O, P and S.

41. The electrodeposited metallic material of any preceding nonconflicting clause, wherein the electrodeposited metallic material is a Co—Zn alloy comprising between 5% to 25% by weight Co, between 75% and 95% by weight Zn, and between 100 ppm and 20,000 ppm combined of non-metallic elements containing at least one non-metallic element selected from the group consisting of B and P and at least one non-metallic element selected from the group consisting of O and S.

42. The electrodeposited metallic material of any preceding nonconflicting clause, wherein the electrodeposited metallic material is a Ni—Co—Zn alloy comprising between 5% and 25% by weight combined of Ni and Co, between 75% and 95% by weight Zn, and between 100 ppm and combined of at least one non-metallic elements selected from the group consisting of B, O, P and S.

43. The electrodeposited metallic material of any preceding nonconflicting clause, wherein the electrodeposited metallic material is a Ni—Co—Zn alloy comprising between 5% and 25% by weight combined of Ni and Co, between 75% and 95% by weight Zn, and between 100 ppm and 20,000 ppm combined containing at least one non-metallic element selected from the group consisting of B and P and at least one non-metallic element selected from the group consisting of O and S.

44. The electrodeposited metallic material of any preceding nonconflicting clause, wherein the concentration of Zn in the Ni—Zn, Co—Zn or Ni—Co—Zn alloy material is at least 75% by weight.

45. The electrodeposited metallic material of any preceding nonconflicting clause, wherein the concentration of Ni and/or Co in the Ni—Zn, Co—Zn or Ni—Co—Zn alloy is equal to or less than 25% by weight.

46. The electrodeposited metallic material of any preceding nonconflicting clause, wherein the electrodeposited metallic material is a Ni—Cu alloy comprising between 5% and 75% by weight Ni, between 10% and 95% by weight Cu, and between 100 ppm and 20,000 ppm combined of at least one non-metallic element selected from the group consisting of B, O, P and S.

47. The electrodeposited metallic material of any preceding nonconflicting clause, wherein the electrodeposited metallic material is a Ni—Cu alloy comprising between 5% and 75% by weight Ni, between 25% and 95% by weight Cu, and between 100 ppm and 20,000 ppm combined of non-metallic elements comprising at least one non-metallic element selected from the group consisting of B and P and at least one non-metallic element selected from the group consisting of O and S.

48. The electrodeposited metallic material of any preceding nonconflicting clause, wherein the concentration of Cu in the Ni—Cu alloy is at least 25% by weight.

49. The electrodeposited metallic material of any preceding nonconflicting clause, wherein the concentration of Ni in the Ni—Cu alloy is equal to or less than 75% by weight.

50. The electrodeposited metallic material of any preceding nonconflicting clause, wherein the electrodeposited metallic material is a Co—Cu alloy comprising between 5% and 75% by weight Co, between 25% and 95% by weight Cu, and between 100 ppm and 20,000 ppm combined of at least one non-metallic element selected from the group consisting of B, O, P and S.

51. The electrodeposited metallic material of any preceding nonconflicting clause, wherein the electrodeposited metallic material is a Co—Cu alloy comprising between 5% and 75% by weight Co, between 25% and 95% by weight Cu, and between 100 ppm and 20,000 ppm combined of non-metallic elements comprising at least one non-metallic element selected from the group consisting of B and P and at least one non-metallic element selected from the group consisting of O and S.

52. The electrodeposited metallic material of any preceding nonconflicting clause, wherein the concentration of Cu in the Co—Cu alloy material is at least 25% by weight.

53. The electrodeposited metallic material of any preceding nonconflicting clause, wherein the concentration of Co in the Co—Cu alloy material is equal to or less than 75% by weight.

54. The electrodeposited metallic material of any preceding nonconflicting clause, wherein the electrodeposited metallic material is a Ni—Co—Cu alloy comprising between 5% to 75% by weight of Ni and/or Co, between 25% and 95% by weight Cu, and between 100 ppm and combined of at least one non-metallic element selected from the group consisting of B, O, P and S.

55. The electrodeposited metallic material of any preceding nonconflicting clause, wherein the electrodeposited metallic material is a Ni—Co—Cu alloy comprising between 5% and 75% by weight Ni and/or Co, between 25% and 95% by weight Cu, and between 100 ppm and 20,000 ppm combined of at least two non-metallic elements selected from the group consisting of B, O, P and S.

56. The electrodeposited metallic material of any preceding nonconflicting clause, wherein the concentration of Cu in the Ni—Co—Cu alloy material is at least 25% by weight.

57. The electrodeposited metallic material of any preceding nonconflicting clause, wherein the concentration of Ni and/or Co in the Ni—Co—Cu alloy material is equal to or less than 75% by weight.

58. The electrodeposited metallic material of any preceding nonconflicting clause, wherein the concentration of the P and/or B in the electrodeposited metallic material is between 1,000 ppm and 10,000 ppm by weight, the concentration of S is between 50 ppm and 1,000 ppm per weight and the concentration of 0 is between 50 ppm and 5,000 ppm per weight.

59. The electrodeposited metallic material of any preceding nonconflicting clause, wherein the Ni—Co alloy comprises between 40% and 90% by weight Ni, between 10% and 60% by weight Co, and between 100 ppm and 20,000 ppm by weight of P and said electrodeposited metallic alloy is free of phosphorous and phosphite.

60. The electrodeposited metallic material of any preceding nonconflicting clause which comprises B.

61. The electrodeposited metallic material of any preceding nonconflicting clause which comprises P.

62. The electrodeposited metallic material of any preceding nonconflicting clause which comprises O.

63. The electrodeposited metallic material of any preceding nonconflicting clause which comprises S.

64. The electrodeposited metallic material of any preceding nonconflicting clause which, as deposited, comprises a grain-refined microstructure with an average a grain-size between 20 nm and 750 nm.

65. The electrodeposited metallic material of any preceding nonconflicting clause, wherein the electrodeposited metallic material comprises particulate additions forming a metal matrix composite.

66. The electrodeposited metallic material of any preceding nonconflicting clause, comprising at least one particulate addition selected from the group consisting of metals, metal oxides, other oxides, carbides of B, Cr, Bi, Si, W, and carbon, carbon fibers, carbon nanotubes, diamond, graphite, graphite fibers and graphene, and glass, glass fibers, fiberglass, metallized fibers, and talc, calcium silicate, silica, calcium carbonate, alumina, titanium dioxide, ferrite, mica and mixed silicates.

67. The electrodeposited metallic material of any preceding nonconflicting clause, comprising particulate addition between 1 and 50% by volume of the electrodeposited metallic material.

68. The electrodeposited metallic material of any preceding nonconflicting clause, containing less than 100 ppm phosphorous and/or phosphite.

69. The electrodeposited metallic material of any preceding clause, containing less than phosphorous and/or phosphite.

70. The electrodeposited metallic material of any preceding nonconflicting clause, wherein the hardness of said electrodeposited metallic material layer after heat-treatment for 12 hours at a temperature of between 25% and 35% of the melting point expressed in Kelvin in an inert atmosphere retains at least 90% of the as-deposited hardness.

Variations

The foregoing description of the invention has been presented describing certain operable and preferred embodiments. It is not intended that the invention should be so limited since variations and modifications thereof will be obvious to those skilled in the art, all of which are within the spirit and scope of the invention.

The invention claimed is:

1. An electrodeposited metallic material comprising:

(i) a microcrystalline grain structure with an average grain-size in the range of 2 to 1,000 nm;

(ii) at least two metallic elements selected from the group consisting of Co, Cu, Fe, Ni and Zn;

iii) each of said metallic element present comprising at least 5% per weight of the metallic material;

(iv) at least one non-metallic element selected from the group consisting of B, O, P and S;

(v) said non-metallic elements in total comprising between 50 ppm and 10,000 ppm per weight of the metallic material;

(vi) wherein the hardness of said electrodeposited metallic material after heat-treatment for 12 hours at a temperature of 100° C. in an inert atmosphere retains at least 90% of the as-deposited hardness, (vii) wherein the metallic elements comprise Co and Ni, the non-metallic elements include P and O, the metallic alloy composition includes $[PO_3]^{3-}$, and said electrodeposited metallic alloy contains less than 75 ppm $[PO_3]^{3-}$.

2. The electrodeposited metallic material of claim 1 which further comprises at least one additional non-metallic element selected from the group consisting of B and S.

3. The electrodeposited metallic material of claim 1 which comprises at least 100 ppm of at least one of elemental P and elemental S.

4. The electrodeposited metallic material of claim 1 wherein the metallic elements present further comprise Fe.

5. The electrodeposited metallic material of claim 1 wherein the at least one additional non-metallic element further includes S.

6. The electrodeposited metallic material of claim 5 wherein the non-metallic elements comprise at least 100 ppm of P and at least 100 ppm of at least one of S and O.

7. The electrodeposited metallic material of claim 1 wherein the at least one additional non-metallic element further includes B.

8. The electrodeposited metallic material of claim 1 wherein the non-metallic elements further comprise B and S.

9. The electrodeposited metallic material of claim 1 wherein the non-metallic elements further comprise at least 100 ppm of at least one of B and P which are present in elemental form.

10. The electrodeposited metallic material according to claim 1, containing particulate additions representing between 1 and 30% per volume.

11. An article including the electrodeposited metallic material according to claim 1, wherein said electrodeposited metallic material has a total thickness in the deposition direction of at least 25 microns and is deposited on a permanent substrate.

12. An article including the electrodeposited metallic material according to claim 1, wherein said electrodeposited metallic material forms at least one layer comprised of the at least two metallic elements and having a total thickness in the deposition direction of at least 25 microns and is deposited on a temporary substrate which is removed after electroplating so that the article is a free-standing article.

13. The electrodeposited metallic material according to claim 1, containing particulate additions representing between 1 and 30% per volume.

14. The electrodeposited metallic material according to claim 1, wherein said electrodeposited metallic material is configured as a nano-laminate comprising at least 25 individual layers.

15. The electrodeposited metallic material according to claim 14, wherein each of said individual layers has a thickness in a range of about 5 nm to about 250 nm.

16. The electrodeposited metallic material according to claim 14, wherein the composition of directly adjacent sub-layers of at least one metallic element and/or at least one of the non-metallic elements varies by at least 5%.

17. The article of claim 1 wherein O is present as $MeO_x$ and/or $MeO_xH_y$, wherein Me is the grain-refined electrodeposited metallic element selected from the group consisting of Co, Cu, Fe, Ni and Zn.

18. An article comprising:

an electrodeposited metallic material consisting of:

(i) at least one metallic layer having a microcrystalline grain structure with an average grain-size in the range of 2 to 1,000 nm;

(ii) metallic elements including Co and Ni combined comprising at least 95% per weight of the metallic alloy layer;

(iii) at least one non-metallic element selected from the group consisting of B, O, P and S;

(iv) the non-metallic elements in total comprising between 50 ppm and 10,000 ppm per weight of the metallic alloy layer; and (v) wherein the hardness of said electrodeposited metallic material after heat-treatment for 12 hours at a temperature of 200° C. in an inert atmosphere retains at least 90% of the as-deposited hardness, (vi) wherein said electrodeposited metallic material contains P and O, the metallic alloy composition includes $[PO_3]^{3-}$ and less than 90 ppm of $[PO_3]^{3-}$.

19. The article according to claim 18 wherein said electrodeposited metallic material is subjected to one or more heat-treatments in the temperature range of between 100° C. and 650° C.

20. The article of claim 18 wherein the non-metallic elements further contain between 100 ppm and 1000 ppm of S.

21. The article of claim 20 wherein said electrodeposited metallic material further contains at least 300 ppm of S.

22. The article of claim 18 wherein said electrodeposited metallic material is subjected to one or more annealing heat-treatments in the temperature range of between 200° C. and 650° C.

23. An article comprising:

an electrodeposited metallic alloy layer, a composition of the metallic alloy layer consisting of:

(i) a microcrystalline grain structure with an average grain-size in the range of 2 to 1,000 nm;

(ii) two metallic elements consisting of Co and Ni, and each of said metallic elements comprising at least 5% per weight of the metallic alloy composition;

(iii) a non-metallic element consisting of P comprising between 100 ppm and 20,000 ppm per weight of the metallic alloy composition, wherein P is in elemental form having an oxidation state of zero, and is an alloying element with the electrodeposited metallic alloy layer;

(iv) particulates in the range of 0 to 95% per volume;

(vii) wherein if the composition of the metallic alloy layer includes at least one additional non-metallic element consisting of O comprising between 50 ppm and 20,000 ppm per weight of the metallic alloy composition, the metallic alloy composition includes $[PO_3]^{3-}$ and less than 75 ppm of P is present in the form of $[PO_3]^{3-}$.

24. The electrodeposited metallic material of claim 23, wherein the non-metallic elements comprise at least 100 ppm of P and at least 100 ppm of O.

25. The electrodeposited metallic material according to claim 23, wherein said electrodeposited metallic material is configured as a nano-laminate comprising at least 25 individual layers.

26. The electrodeposited metallic material according to claim 25, wherein each of said individual layers has a thickness in a range of about 5 nm to about 250 nm.

27. The electrodeposited metallic material according to claim 25, wherein the composition of directly adjacent sub-layers of at least one metallic element and/or at least one of the non-metallic elements varies by at least 5%.

28. The article according to claim 23, wherein said electrodeposited metallic material is subjected to one or more heat-treatments in the temperature range of between 100° C. and 650° C.

29. The article of claim 23, wherein O is present as $MeO_x$ and/or $MeO_xH_y$, wherein Me is the grain-refined electrodeposited metallic element selected from Co and Ni.

* * * * *